US010676300B2

(12) United States Patent
Nakajima

(10) Patent No.: US 10,676,300 B2
(45) Date of Patent: Jun. 9, 2020

(54) SHEET FEEDING APPARATUS AND IMAGE FORMING APPARATUS

(71) Applicant: CANON KABUSHIKI KAISHA, Tokyo (JP)

(72) Inventor: Keita Nakajima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/223,753

(22) Filed: Dec. 18, 2018

(65) Prior Publication Data

US 2019/0193971 A1 Jun. 27, 2019

(30) Foreign Application Priority Data

Dec. 22, 2017 (JP) ..... 2017-246426
Nov. 6, 2018 (JP) ..... 2018-209244

(51) Int. Cl.

| | |
|---|---|
| ***B65H 7/18*** | (2006.01) |
| ***B65H 3/06*** | (2006.01) |
| ***B65H 3/52*** | (2006.01) |
| ***B65H 5/06*** | (2006.01) |
| ***B65H 7/02*** | (2006.01) |

(52) U.S. Cl.

CPC ..... *B65H 7/18* (2013.01); *B65H 3/0676* (2013.01); *B65H 3/0684* (2013.01); *B65H 3/5261* (2013.01); *B65H 5/062* (2013.01); *B65H 7/02* (2013.01); *B65H 2511/11* (2013.01); *B65H 2511/22* (2013.01); *B65H 2513/41* (2013.01); *B65H 2513/514* (2013.01); *B65H 2553/51* (2013.01)

(58) Field of Classification Search

CPC ..... B65H 7/18; B65H 3/0684; B65H 3/0669; B65H 3/5261; B65H 3/5246; B65H 3/5253; B65H 2513/50; B65H 2513/514

See application file for complete search history.

(56) References Cited

U.S. PATENT DOCUMENTS

| | | | | |
|---|---|---|---|---|
| 4,203,586 | A * | 5/1980 | Hoyer | B65H 7/12 271/122 |
| 7,658,374 | B2 * | 2/2010 | Yasukawa | B65H 3/06 271/111 |
| 7,699,311 | B2 | 4/2010 | Serizawa et al. | |
| 7,887,043 | B2 * | 2/2011 | Takamori | B65H 3/0684 271/121 |
| 8,444,135 | B2 * | 5/2013 | Morita | B65H 7/14 271/265.01 |
| 9,944,480 | B2 * | 4/2018 | Hirano | B65H 7/12 |

(Continued)

FOREIGN PATENT DOCUMENTS

| | | | |
|---|---|---|---|
| JP | 2003-206038 | A | 7/2003 |
| JP | 2004107088 | A * | 4/2004 |

(Continued)

*Primary Examiner* — Luis A Gonzalez
(74) *Attorney, Agent, or Firm* — Venable LLP

(57) ABSTRACT

The sheet feeding apparatus includes an encoder configured to output a signal according to the rotation state of a retard roller, a feed motor configured to drive a pick-up roller, and a control unit configured to control the feed motor, make the pick-up roller feed a first sheet, and change the timing at which the pick-up roller is made to feed a second sheet following the first sheet, based on a signal output from the encoder after the trailing edge of the first sheet passes a separation nip portion.

18 Claims, 15 Drawing Sheets

(56) References Cited

U.S. PATENT DOCUMENTS

| | | | | |
|---|---|---|---|---|
| 2010/0148423 | A1* | 6/2010 | Morita | B65H 3/0684<br>271/10.03 |
| 2011/0006469 | A1* | 1/2011 | Matsushima | B65H 1/266<br>271/4.1 |
| 2017/0166411 | A1 | 6/2017 | Kawarago et al. | |

FOREIGN PATENT DOCUMENTS

| | | | | |
|---|---|---|---|---|
| JP | 2006-282355 | A | | 10/2006 |
| JP | 2012-232839 | A | | 11/2012 |
| JP | 2014058400 | A | * | 4/2014 |
| JP | 2014177326 | A | * | 9/2014 |
| JP | 2017-105602 | A | | 6/2017 |

* cited by examiner

SHEET FEEDING APPARATUS AND IMAGE FORMING APPARATUS

BACKGROUND OF THE INVENTION

Field of the Invention

The present invention relates to a sheet feeding apparatus and an image forming apparatus, and particularly relates to a sheet feeding apparatus that is provided in an image forming apparatus, such as a printer, a facsimile machine, and a copying machine, and supplies sheets, such as recording sheets and documents.

Description of the Related Art

Some conventional image forming apparatuses include a sheet feeding apparatus for automatically feeding sheets toward an image forming portion that forms images on the sheets. The sheet feeding apparatus includes a sheet stacking portion provided so as to be able to move upward and downward, and a sheet feeding unit sending out the top sheet of the sheets stacked on the sheet stacking portion. Then, after the sheet stacking portion is moved upward, and the top sheet is located at a sheet feedable position, the top sheet is sent out to the image forming portion by the sheet feeding unit.

An example of the sheet feeding apparatus is described by using FIGS. 12A and 12B. A feeding cassette 1006 as the sheet stacking portion can be pulled out from an apparatus main body 1100. In the state where the feeding cassette 1006 is pulled out, sheets S are loaded on a middle board 1007 as the sheet stacking portion provided in the feeding cassette 1006. A sheet feeding unit 1000 for sequentially sending out the sheets S stacked on the middle board 1007 is arranged in the apparatus main body 1100. This sheet feeding unit 1000 includes a pick-up roller 1001 that contacts the upper surface of the sheets S on the middle board 1007 and sends out a top sheet S1, and a separation portion 1002 that separates the sheets S sent out from the pick-up roller 1001 into discrete sheets. This separation portion 1002 includes a feed roller 1003 and a retard roller 1004. The feed roller 1003 is driven to rotate in the direction for feeding the sheets S. The retard roller 1004 can be oscillated about an oscillation center 1004*c*, is pressed against the feed roller 1003 by being urged in an arrow Y1 direction by a spring (not shown) as an urge member, and is driven to rotate in the direction for returning the sheets S via a torque limiter (not shown).

In conventional image forming apparatuses, when continuously feeding sheets, in order to maintain a constant throughput, some image forming apparatuses perform feeding at a constant time interval. Additionally, for example, Japanese Patent Application Laid-Open No. 2003-206038 discloses a feeding apparatus detecting that the trailing edge of a preceding sheet has passed by a sensor provided in a conveying path, and on the basis of the detection result, performing the feeding of the next sheet immediately after the detection or a predetermined time after the detection, so as to keep a constant distance between the sheets at the time of feeding. The throughput refers to the number of sheets on which images are formed per unit time. The distance between the sheets refers to the distance from the trailing edge of a preceding sheet to the leading edge of the next sheet.

Recently, in image forming apparatuses, especially in image forming apparatuses configured to start writing of an image to be transferred on a sheet after the sheet is fed, there has been a great need to shorten the distance between the sheets at the time of feeding as much as possible for the reasons of productivity improvement and the like. However, when the distance between the sheets at the time of feeding is narrowed too much, the following feeding failures tend to occur. When the trailing edge of the preceding sheet that is fed passes the separation portion 1002, under the influence of the passed sheet, the retard roller 1004 is separated from the feed roller 1003, and is oscillated and vibrated about the oscillation center 1004*c*. While the retard roller 1004 is vibrated and separated from the feed roller 1003, there is no resistance to the driving to rotate in the reverse direction to the feeding direction of the retard roller 1004. However, while contacting the feed roller 1003, since the reaction force is received with respect to reverse rotation, the rotation of the retard roller 1004 becomes unstable. Therefore, when the next sheet is fed, and the leading edge of the next sheet enters the separation portion 1002 while the retard roller 1004 is vibrating, the following will occur. That is, the leading edge of the next sheet may be folded, since the leading edge of the next sheet contacts the retard roller 1004 that is not being rotated or is rotated in the reverse direction to the feeding direction. Additionally, when a sheet bundle is conveyed to the separation portion 1002 while the retard roller 1004 is separated from the feed roller 1003, the sheet bundle cannot be separated into discrete sheets. Thus, feeding failures, such as double feeding, tend to occur. The time during which the retard roller 1004 is vibrated varies due to the following factors. For example, there are the pressure under which the retard roller 1004 is pressed against the feed roller 1003, the sheet friction coefficient, the rigidity of the sheet, the friction coefficients of the feed roller 1003 and the retard roller 1004, the torque of the torque limiter (not shown) provided on a retard roller axis, and the like. Therefore, conventionally, in image forming apparatuses in which the feeding is performed at a constant time interval, the feeding interval is set so that the distance between the sheets is achieved with which the feeding failures do not occur, even when the vibration time is the longest. Additionally, in image forming apparatuses detecting that the trailing edge of the preceding sheet has passed by a sensor provided in a conveying path, and on the basis of the detection result, performing the feeding of the next sheet immediately after the detection or a predetermined time after the detection, the following configuration is adopted. That is, the distance from the separation portion 1002 to the sensor in the feeding direction, or the time after the sensor detects the trailing edge of a preceding sheet until the feeding of the next sheet is started is set. However, when the distance between the sheets at the time of feeding was set as in a conventional manner, depending on the conditions of the sheet feeding apparatus used, the distance between the sheets became unnecessarily long, and the throughput was not optimized.

SUMMARY OF THE INVENTION

An aspect of the present invention has been conceived under such circumstances, and is a feeding apparatus that can achieve the improvement of productivity, without causing a deterioration in the feeding performance.

Another aspect of the present invention is a sheet feeding apparatus including a sheet stacking unit on which sheets are stacked, a feeding rotary member configured to feed the sheets from the sheet stacking unit, a conveyance rotary member configured to convey the sheets fed by the feeding rotary member, a separation rotary member forming a nip portion with the conveyance rotary member, and separating the sheets into discrete sheets in the nip portion, the separation rotary member urged to the conveyance rotary member by an urging member, an output unit configured to output a signal according to a rotation state of the separation rotary member, a driving unit configured to drive the feeding rotary member, and a control unit configured to control the driving unit to make the feeding rotary member feed a first sheet, and change a timing at which the feeding rotary member feeds a second sheet following the first sheet based on the signal output from the output unit after a trailing edge of the first sheet passes the nip portion.

A further aspect of the present invention is a sheet feeding apparatus including a sheet stacking portion on which sheets are stacked, a feeding rotary member configured to feed the sheets from the sheet stacking portion, a conveyance rotary member configured to convey the sheets that are fed by the feeding rotary member, a separation rotary member forming a nip portion with the conveyance rotary member, and separating the sheets into discrete sheets in the nip portion, the separation rotary member being urged to the conveyance rotary member by an urging member, a holder configured to hold the separation rotary member, a detection unit configured to detect an acceleration of the holder, a driving unit configured to drive the feeding rotary member, and a control unit configured to control the driving unit, make the feeding rotary member feed a first sheet, and change a timing at which the feeding rotary member is made to feed a second sheet following the first sheet, based on the acceleration detected by the detection unit after a trailing edge of the first sheet passes the nip portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of the present invention are described in detail with reference to the drawings by using Examples.

Example 1

[Image Forming Apparatus]

Figure 1:
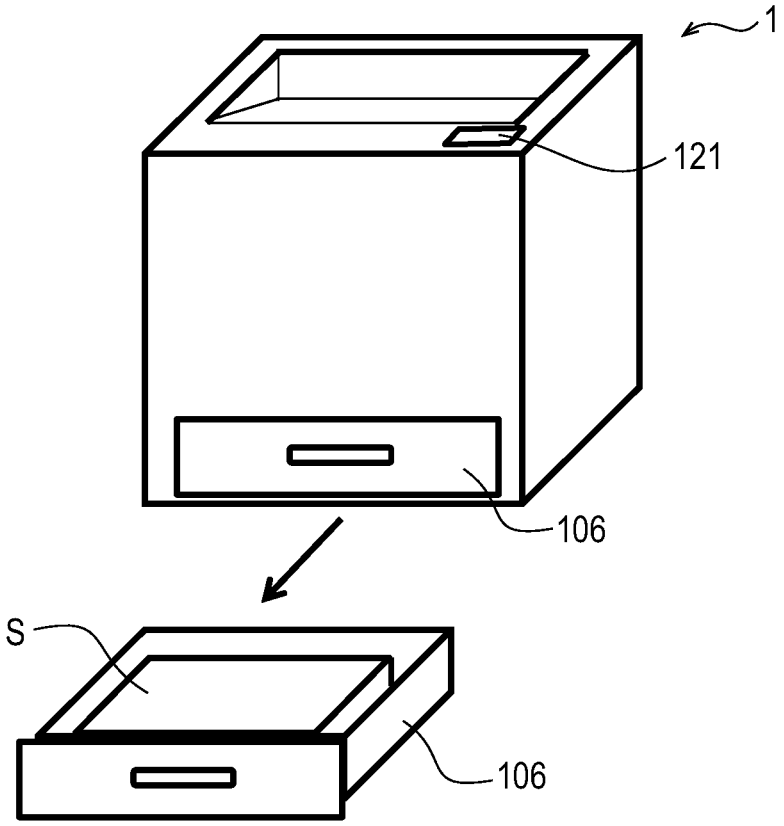
FIG. 1 is a general perspective view of a printer 1 of Examples 1 to 4.
Figure 2:
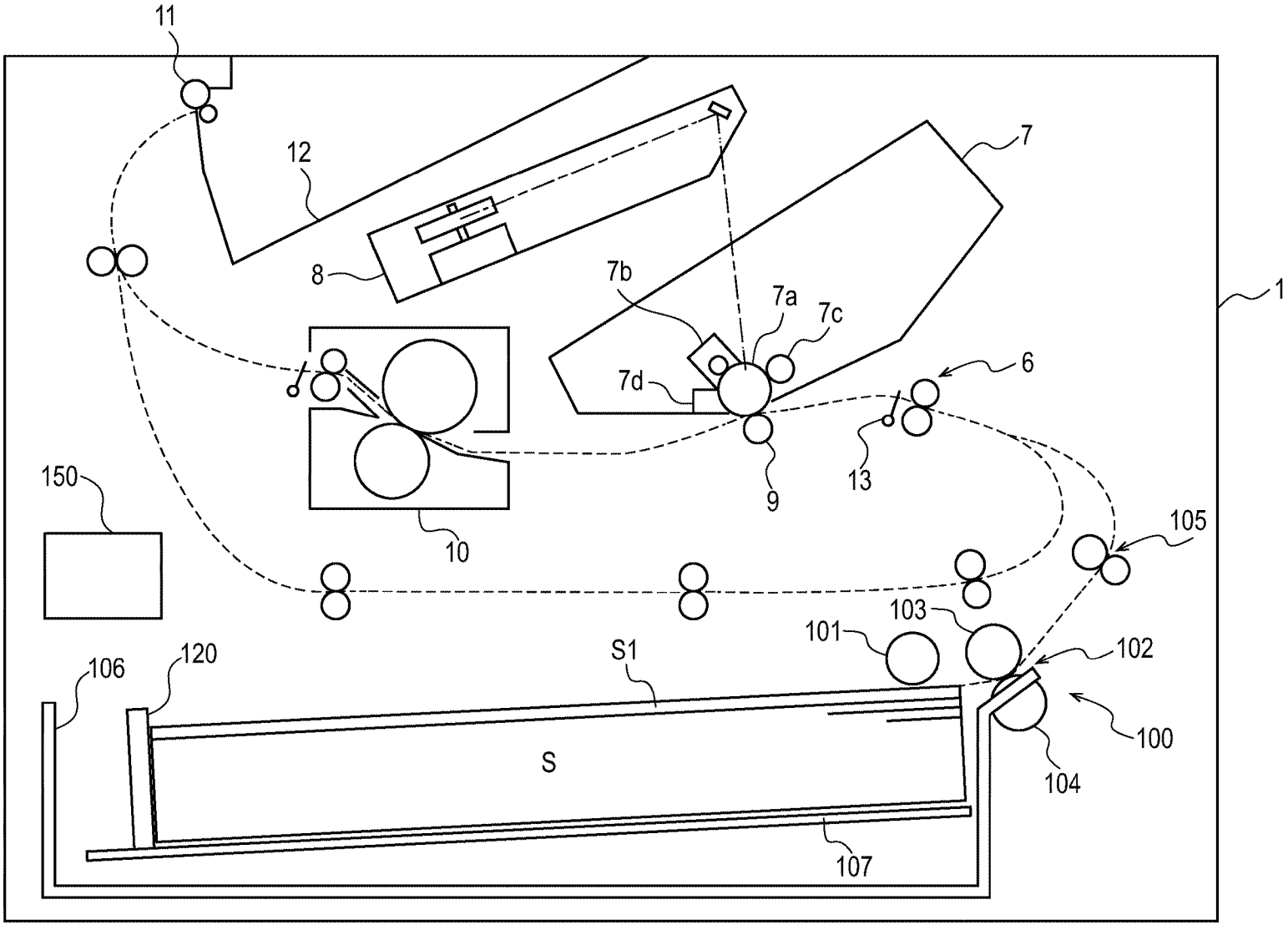
FIG. 2 is a cross-sectional view of the printer 1 of Examples 1 to 4.

A sheet feeding apparatus provided in a laser beam printer (hereinafter referred to as the printer) as an image forming apparatus of Example 1 is described as an example. First, the outline of the configuration of the printer is described by using FIGS. 1 and 2. FIG. 1 is a general image of the printer, and FIG. 2 is a cross-sectional view illustrating the general configuration of the printer including a feeding cassette 106, which is a sheet stacking portion. A printer 1, which is an image forming apparatus, includes the feeding cassette 106 and a display unit 121 that displays information to a user. The feeding cassette 106 is provided inside the printer 1, and the sheets S are stacked and stored on the feeding cassette 106. The feeding cassette 106 is provided with a middle board 107 on which the sheets S are stacked, and is movable in a feeding direction (that is also a conveyance direction) and in the direction opposite to the feeding direction (the opposite direction) of the sheets S. The feeding cassette 106 includes a sheet trailing edge regulating portion 120 that regulates the position of the trailing edge in the feeding direction of the sheets S stacked on the middle board 107. A sheet feeding unit 100 is provided above the feeding cassette 106. The sheet feeding unit 100 includes a pick-up roller 101 that is a feeding rotary member, a feed roller 103 that is a first conveyance rotary member, and a retard roller 104 that is a separation rotary member. The retard roller 104 can be oscillated about an oscillation center 104*c*. The retard roller 104 is pressed against the feed roller 103 by being urged toward the feed roller 103 via a spring (not shown) by an urging member. The pick-up roller 101 contacts and sends out the top sheet S1 of the sheets S stacked on the feeding cassette 106. The feed roller 103 and the retard roller 104 contact each other, and form a separation nip portion 102, and in the separation nip portion 102, the sheets S sent out by the pick-up roller 101 are separated into discrete sheets and conveyed.

A process cartridge 7 is a process cartridge housing a process means of a known electrophotography system for image forming, and is removably provided in the printer 1. A photosensitive drum 7*a* as an image carrier is housed in the process cartridge 7, and writing is performed by irradiating laser light to the photosensitive drum 7*a* by a laser exposure apparatus 8 according to image information. Additionally, a charging device 7*b*, a developing device 7*c*, a cleaning device 7*d*, etc., are arranged around the photosensitive drum 7*a*, and the development of a toner image and cleaning are performed. The sheets S sent out from the sheet feeding unit 100 pass through conveyance rollers 105 that are second conveyance rotary members and registration rollers (hereinafter referred to as the resist rollers) 6, which are provided in a sheet conveying path illustrated by a broken line. When the leading edge of the sheet S that passed the resist roller 6 is detected by a top sensor 13 arranged more downstream in the conveyance direction than the resist roller 6, the sheet S is conveyed to a transfer nip portion so that the position of the sheet S and the position of a toner image are aligned. Here, the transfer nip portion is a nip portion formed by the photosensitive drum 7*a* and a transfer roller 9, which is a transfer means contacting the photosensitive drum 7*a*. Thereafter, the toner image developed on the surface of the photosensitive drum 7*a* is transferred to the sheet S that passes through between the photosensitive drum 7*a* and the transfer roller 9. A fixing apparatus 10 fixes the toner image by applying heat and pressure to the sheet S on which an unfixed toner image was transferred. Then, the sheet S on which the toner image is fixed is discharged by a pair of discharge rollers 11 to a discharging tray 12 with the image surface facing down. The discharging tray 12 is formed on an upper surface of the printer 1. Further, the configuration of the image forming portion of the printer 1 may be other configurations, and is not limited to the configuration of FIG. 2. For example, the configuration of the image forming portion of the printer 1 may be a color printer including a plurality of process cartridges corresponding to a plurality of colors.

The printer 1 includes a control portion 150, which is a control unit. The control portion 150 controls the operation of the entire printer 1 according to a program stored in advance in, for example, a ROM (not shown) provided inside the control portion 150, while using, for example, a RAM (not shown) provided inside the control portion 150 as a workspace. The control portion 150 also controls a feeding operation, etc. of the sheets S by the sheet feeding unit 100 as the sheet feeding apparatus. That is, the control portion 150 controls the control of a feed motor 110, the connection or disconnection of an electromagnetic clutch 112 (see FIGS. 3A to 3C) (ON/OFF of the electromagnetic clutch 112 by a feeding signal), and the like, which are described below. Additionally, the control portion 150 controls the contact to/separation from the sheets S by a pick-up roller 101 described below. Additionally, the control portion 150 performs various determinations based on the detection result by a detection unit described below (see FIGS. 6A to 6G). Further, the control portion 150 includes a timer (not shown) inside the control portion 150, and measures the passage of time (t1, t2, t3) described below by the timer. The same applies to Example 2 and subsequent examples.

[Sheet Feeding Unit]

Figure 3A:
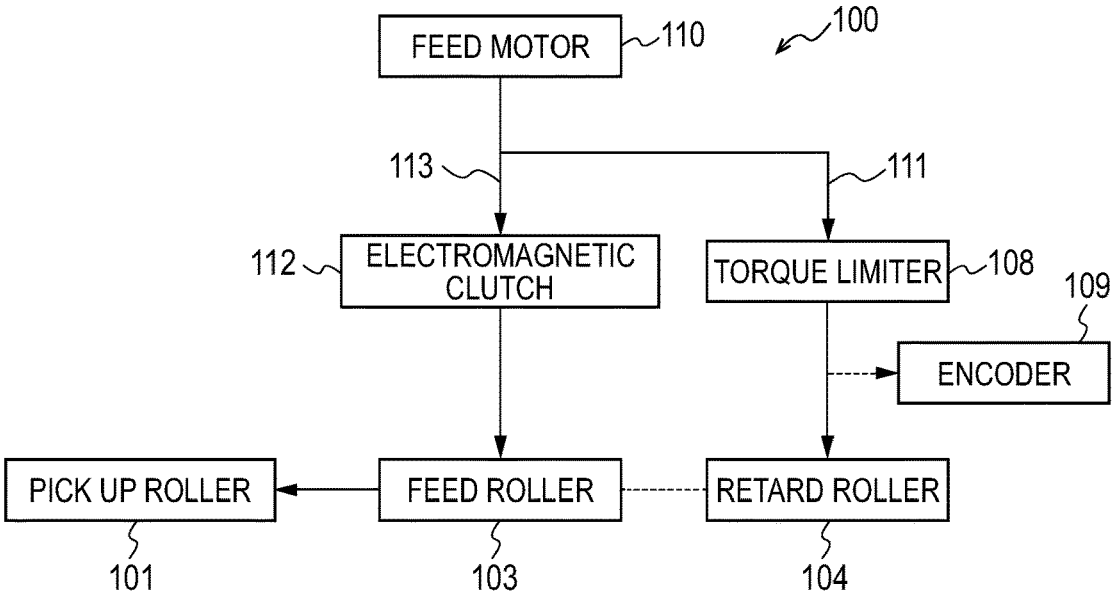
FIGS. 3A, 3B and 3C are schematic diagrams of a driving column of a sheet feeding unit 100 of Example 1.
Figure 3B:
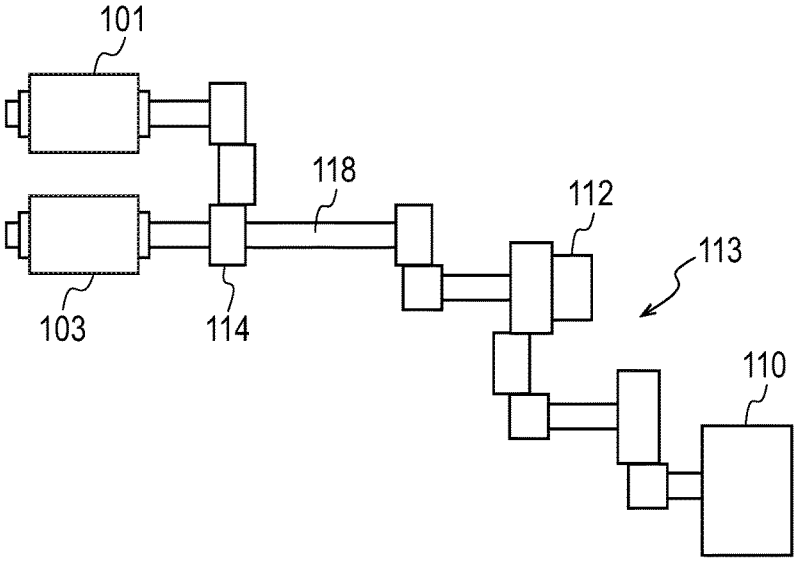
Figure 3C:
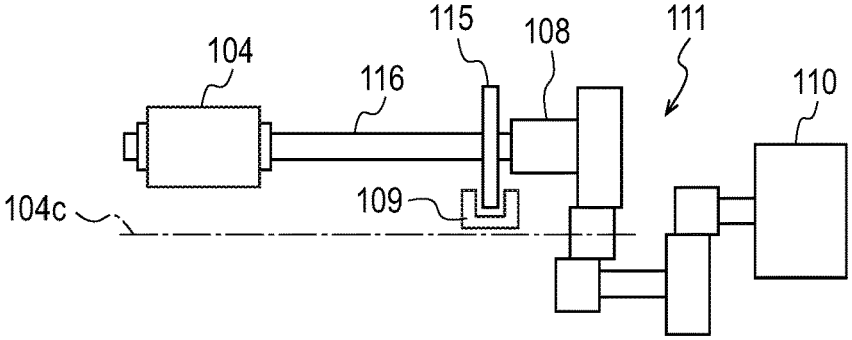
Figure 4:
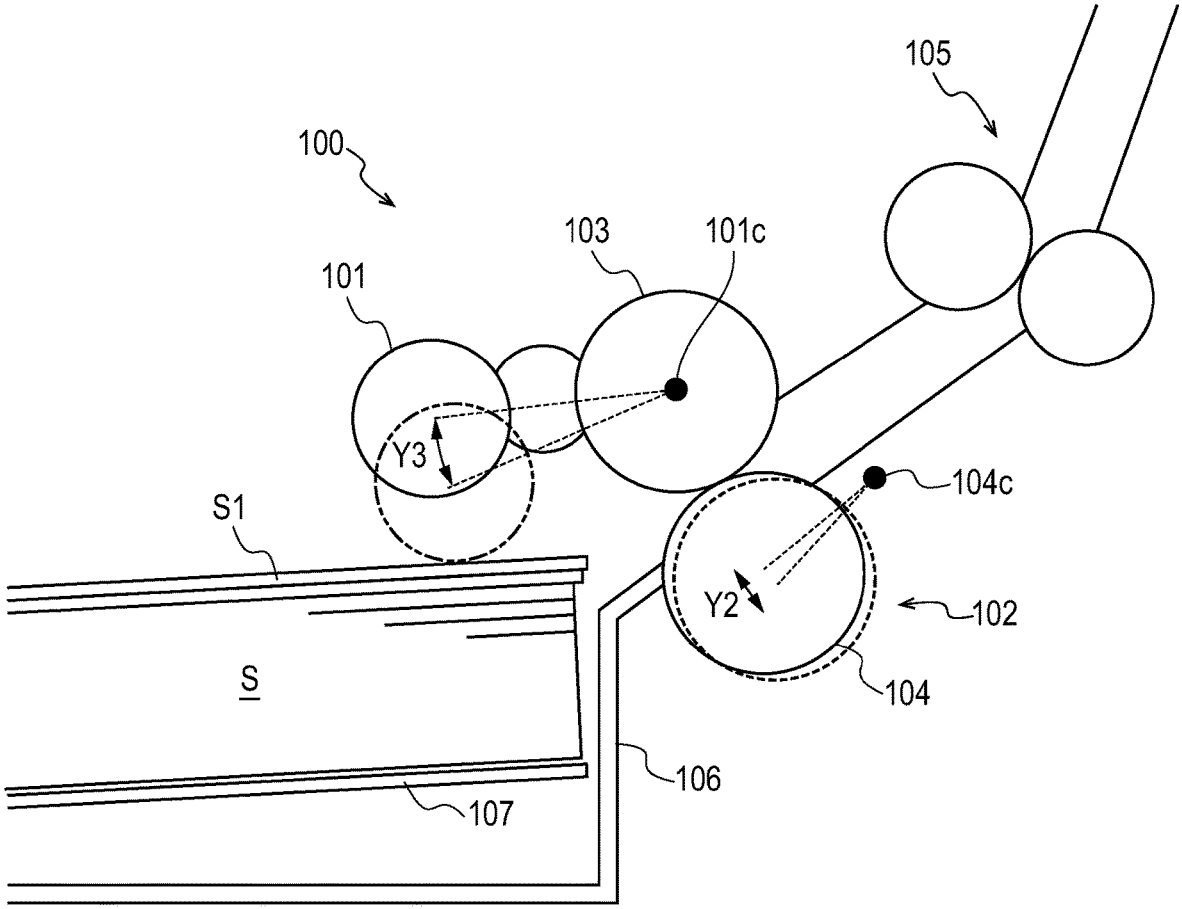
FIG. 4 is a cross-sectional view of the sheet feeding unit 100 of Example 1.

Here, the detailed configuration of the sheet feeding unit 100 of Example 1 is described by using FIGS. 3A to 3C and FIG. 4. FIGS. 3A to 3C are schematic diagrams of a driving column of the sheet feeding unit 100, and FIG. 4 is a cross-sectional view of the sheet feeding unit 100. FIG. 3A is a block diagram for describing transmission of a driving force, and FIGS. 3B and 3C are side views for describing transmission of the driving force from a driving source to each roller. The feed motor 110, which is the driving source, drives and rotates the feed roller 103 and the pick-up roller 101 in the feeding direction via a feed roller driving gear column 113 including the electromagnetic clutch 112. Additionally, the feed roller driving gear column 113 includes a one-way clutch gear 114 in which a one-way clutch is housed. The one-way clutch gear 114 gives a rotational load to the pick-up roller 101, and is set to perform idle rotation when a feed shaft 118 holding the feed roller 103 is made to perform reverse rotation with respect to the feeding direction.

On the other hand, the driving in the direction opposite to the feeding direction is transmitted to the retard roller 104 via a retard roller driving gear column 111 including a torque limiter 108 with the feed motor 110 as a driving source. The drive transmission force of the torque limiter 108 is always set to be greater than the frictional force generated between the sheets due to the friction coefficient of the sheets S used. Additionally, the drive transmission force of the torque limiter 108 is set to be smaller than the frictional force due to the friction coefficient between the sheet S and the feed roller 103. Therefore, when the number of the sheets S entering the separation nip portion 102 is one, or when the sheet S has not entered the separation nip portion 102, the retard roller 104 corotates with the sheet S or the feed roller 103. Additionally, when two or more sheets S enter the separation nip portion 102, the retard roller 104 is rotated in the direction opposite to the feeding direction, and separates the sheets S into discrete sheets.

Additionally, in the retard roller driving gear column 111, a code wheel 115 is provided to a retard axis 116 holding the retard roller 104. An encoder 109 is an output unit that outputs a signal according to the rotation state of the code wheel 115 to the control portion 150. The control portion 150 can determine that the retard roller 104 is performing normal rotation or reverse rotation, and can determine the angular velocity of the rotation of the retard roller 104, based on the output signal of the encoder 109. Accordingly, the control portion 150 can detect that the rotation of the retard roller 104 is unstable, when the retard roller 104 is vibrating in arrow Y2 directions about the retard roller oscillation center 104*c* as the oscillation center. Further, the pick-up roller 101 can contact or can be separated from the top sheet S1 of the sheets S stacked on the feeding cassette 106 by oscillating in arrow Y3 directions about a pick-up roller oscillation center 101*c* as the oscillation center.

<A Series of Operations of Sheet Feeding Unit 100 in the Case of Printing Job Specifying One Sheet>

Figure 5A:
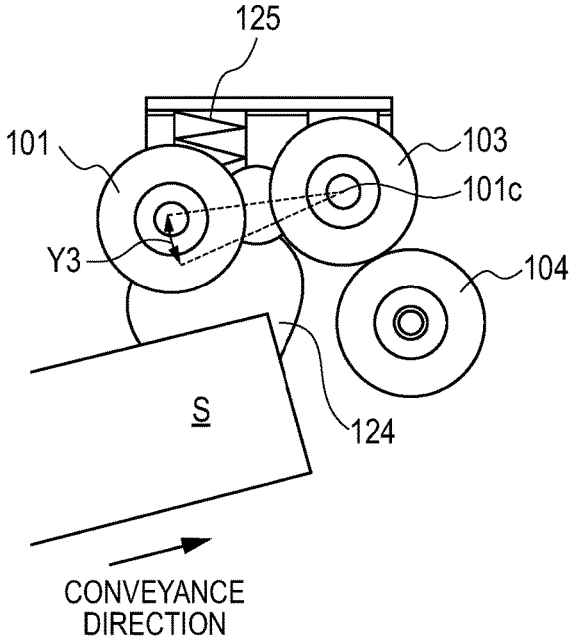
FIGS. 5A, 5B, 5C and 5D are cross-sectional views of the sheet feeding unit 100 of Example 1.
Figure 5B:
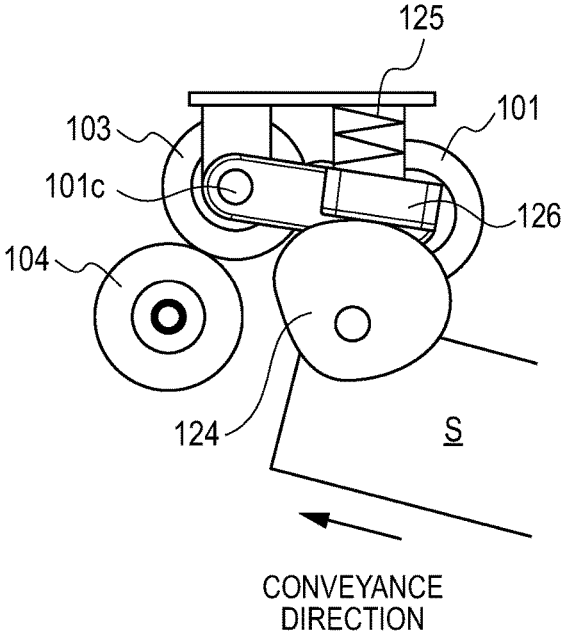
Figure 5C:
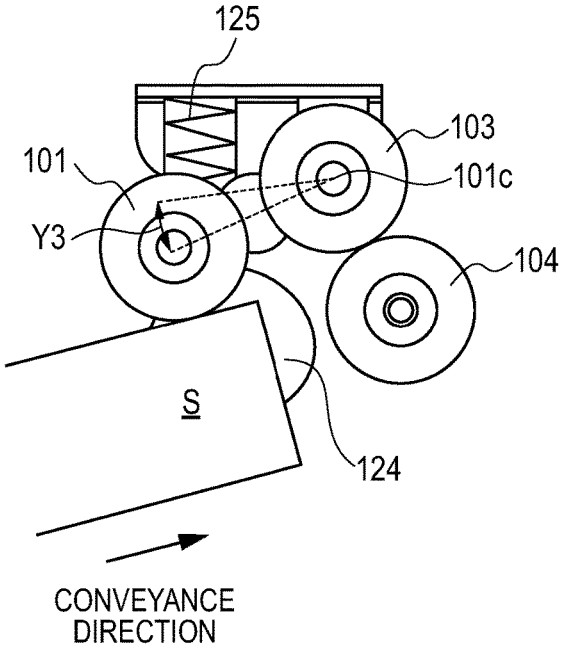
Figure 5D:
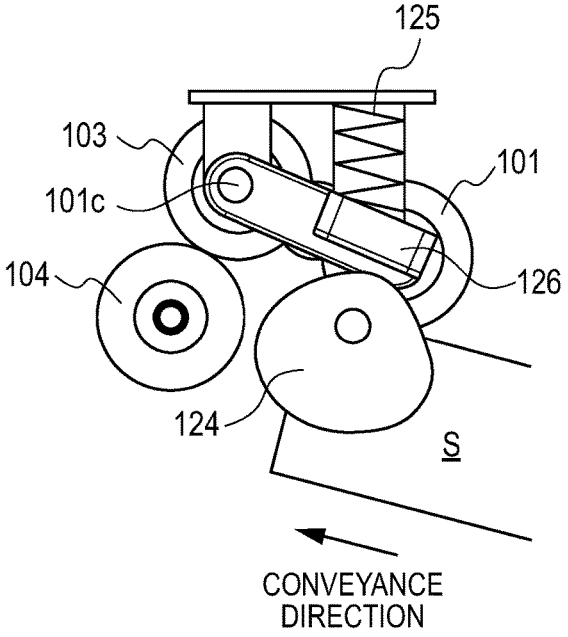

FIGS. 5A and 5B represent the state where the pick-up roller 101 is separated from the sheets S, FIG. 5A is a cross-sectional view from the left side surface, and FIG. 5B is a cross-sectional view from the right side surface. FIGS. 5C and 5D represent the state where the pick-up roller 101 is contacting the sheets S, FIG. 5C is a cross-sectional view from the left side surface, and FIG. 5D is a cross-sectional view from the right side surface. The conveyance direction (the feeding direction) of the sheets S is indicated by an arrow in each of the figures.

As illustrated in FIGS. 5A and 5B, a pick roller pushing spring 125 is always pushing a pick holder 126 holding the pick-up roller 101 in the direction in which the pick-up roller 101 contacts the sheets S. Before starting a feeding operation, the pick-up roller 101 is separated from the sheets S by setting a pick roller contact separation cam 124 to the phase with which the pick roller contact separation cam 124 contacts the pick holder 126. When a feeding signal for starting the feeding operation is sent, the feed motor 110 is driven to rotate, and the retard roller 104 performs reverse rotation with respect to the feeding direction via the torque limiter 108. On this occasion, since the electromagnetic clutch 112 is not driven and coupled in a nonenergized state, the feed roller 103 contacting the retard roller 104 that is performing reverse rotation corotates with the retard roller 104, and performs reverse rotation with respect to the feeding direction.

Then, with the start of driving and rotation of the feed motor 110, as illustrated in FIGS. 5C and 5D, the pick roller contact separation cam 124 is set to the phase with which the pick roller contact separation cam 124 is separated from the pick holder 126. The pick-up roller 101 separated from the sheets S is oscillated in the arrow Y3 directions about the pick-up roller oscillation center 101*c* as the oscillation center, and contacts the sheets S by a pushing force by the pick roller pushing spring 125. The pick-up roller 101 after contacting the sheets S does not rotate, since the one-way clutch gear 114 performs idle rotation. Thereafter, by energizing the electromagnetic clutch 112, the electromagnetic clutch 112 couples driving, rotates the feed roller 103 and the pick-up roller 101 in the feeding direction, and feeds the sheets S from the feeding cassette 106. After the leading edge of the sheet S that is being conveyed passes the separation nip portion 102, the pick-up roller 101 is separated from the sheets S by setting the pick roller contact separation cam 124 to the phase with which the pick roller contact separation cam 124 contacts the pick holder 126. Then, after the leading edge of the sheet S passes the conveyance roller 105, the energization of the electromagnetic clutch 112 is stopped, and the coupling of driving is canceled. The feed roller 103 and the retard roller 104 follow the sheets S conveyed by the conveyance roller 105. The feed motor 110 stops driving and rotation, after the trailing edge of the sheet S passes the nip portion of the resist roller 6, which is the roller located most downstream in the feeding direction among the rollers driven by the feed motor 110.

<A Series of Operations of Sheet Feeding Unit 100 during Continuous Feeding>

Figure 6A:
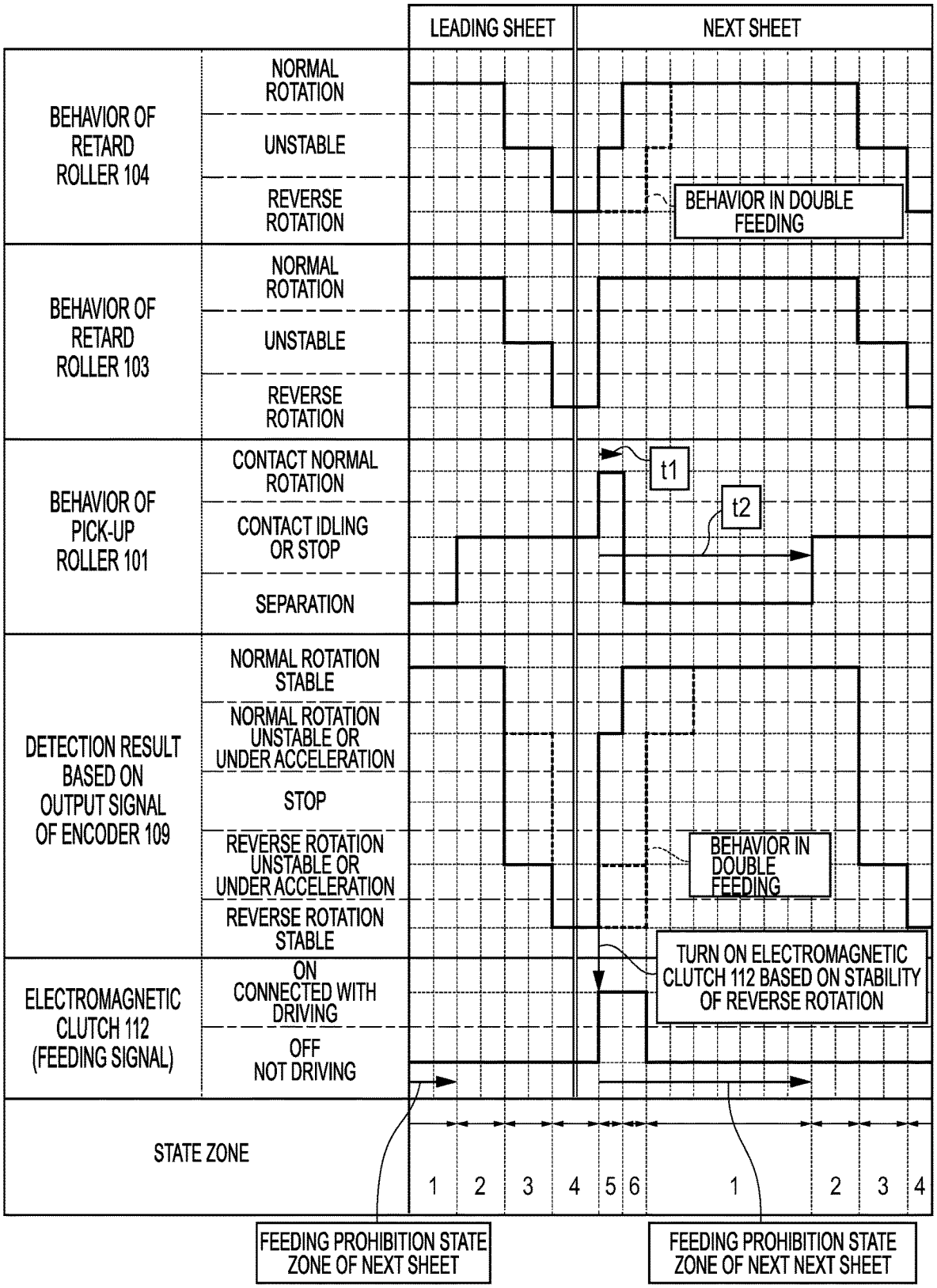
FIGS. 6A, 6B, 6C, 6D, 6E, 6F and 6G are explanatory diagrams of a series of operations of the sheet feeding unit 100 of Example 1.
Figure 6B:
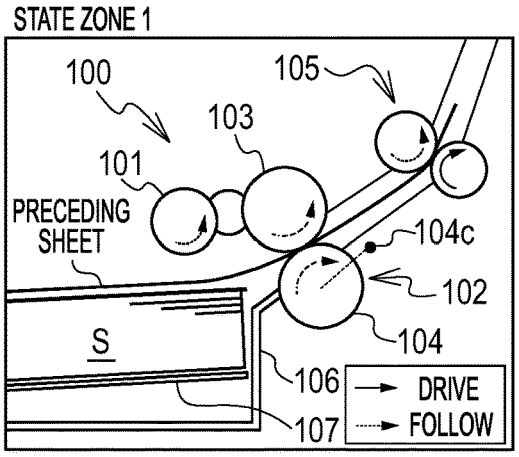
Figure 6C:
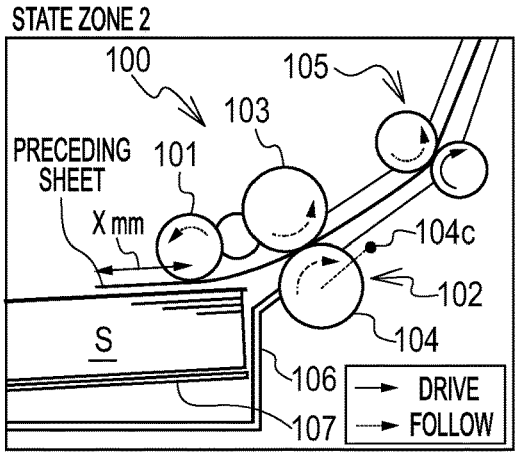
Figure 6D:
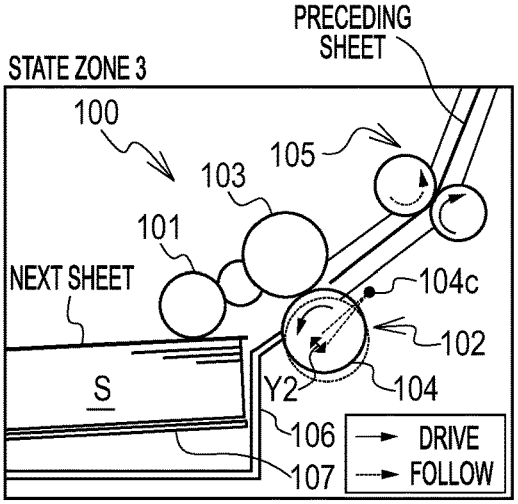
Figure 6E:
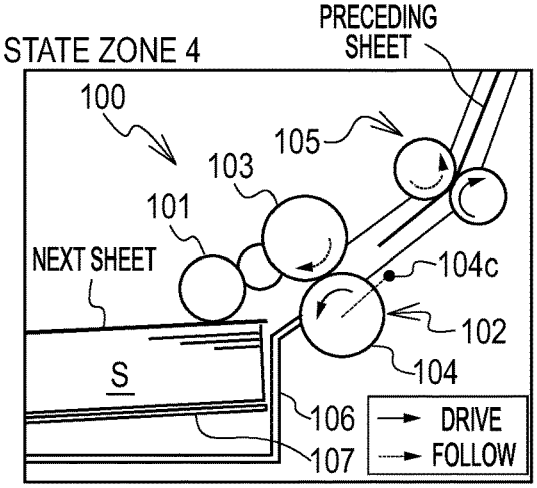
Figure 6F:
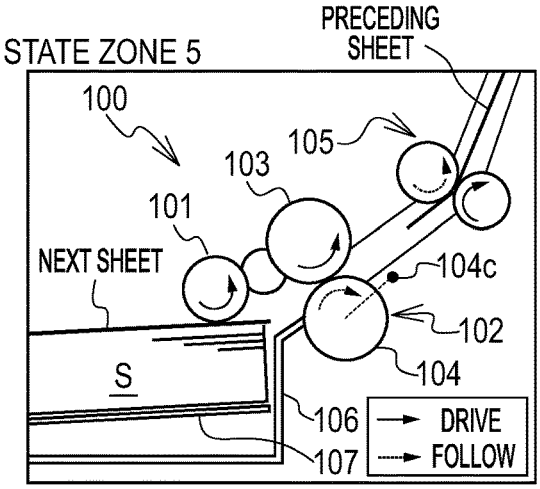
Figure 6G:
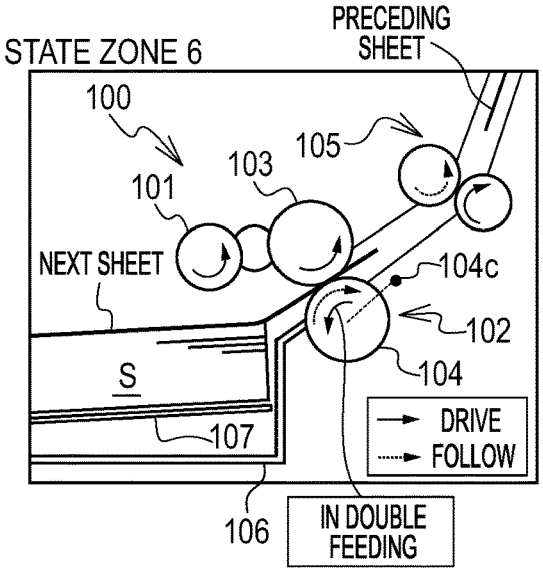

Using FIGS. 6A to 6G, the operations in the case of continuously feeding a plurality of sheets by the pick-up roller 101 (hereinafter referred to as the continuous feeding) are described by dividing the time into state zones. In FIG. 6A, the horizontal axis represents the time, and the vertical axis represents the behavior of the retard roller 104, the behavior of the feed roller 103, the behavior of the pick-up roller 101, the detection result based on the output signal of the encoder 109, ON/OFF of the electromagnetic clutch 112, and the state zones. The behavior of each roller is expressed by "normal rotation", "unstable", "reverse rotation", etc. Further, for each roller, the rotation in the feeding direction is referred to as normal rotation, and the rotation in the direction opposite to the feeding direction is referred to as reverse rotation. Additionally, ON/OFF of the electromagnetic clutch 112 corresponds to the feeding signal. When the feeding signal is at a high level, this represents that the electromagnetic clutch 112 is "ON" and is performing driving and coupling. When the feeding signal is at a low level, this represents that the electromagnetic clutch 112 is "OFF" and is not driving. Further, the state zones include a state zone 1 to a state zone 6. FIGS. 6B to 6G are cross-sectional views of the sheet feeding unit 100 in the state zone 1 to the state zone 6, respectively. Additionally, as for arrows indicating the rotation directions of respective rollers, continuous lines indicate that rotation is made by the driving source, and broken lines indicate following rotation.

Figure 7:
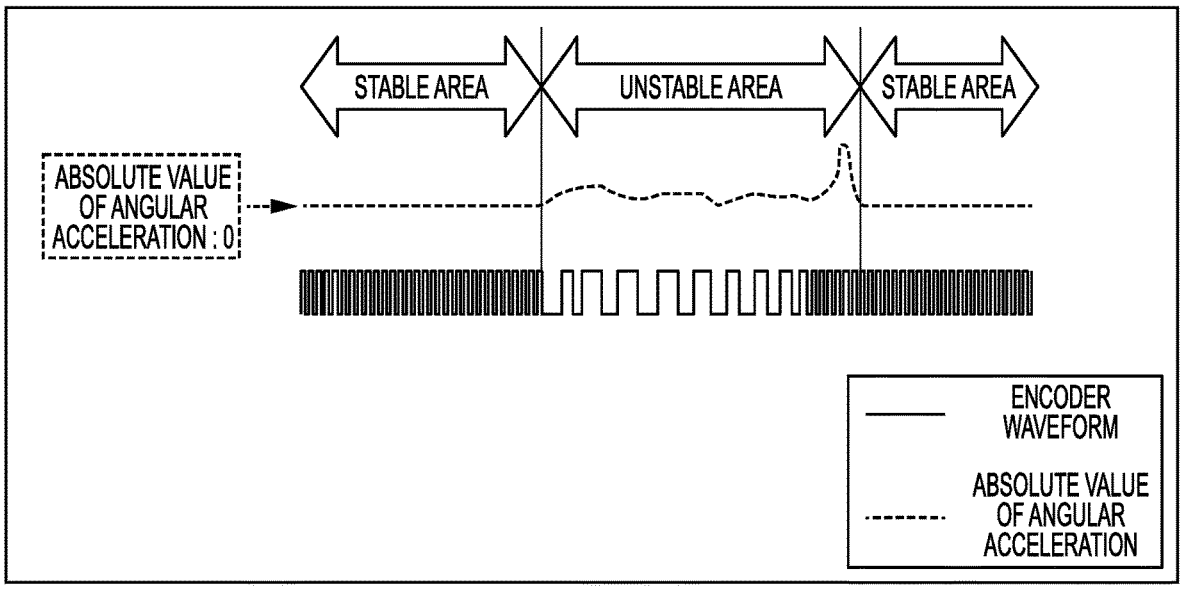
FIG. 7 is a diagram illustrating an output signal of an encoder 109 of Example 1.

During the continuous feeding, the feed motor 110 is always driven to rotate, and the retard roller 104 is driven in the direction opposite to the feeding direction (the direction for performing reverse rotation) via the torque limiter 108, as described with reference to FIG. 3C. The control portion 150 measures the absolute values of the angular velocity and the angular acceleration of the rotation frequency of the retard roller 104 based on the waveform of the output signal of the encoder 109. When the state where the absolute value of the angular acceleration of the retard roller 104 is smaller than the absolute value of a predetermined angular acceleration is continued for a predetermined time from the detection result based on the output signal of the encoder 109, the control portion 150 determines that the rotation is in a steady state and is stabilized (stable area). On the other hand, when the absolute value of the angular acceleration of the retard roller 104 is equal to or larger than the absolute value of a predetermined angular acceleration from the detection result based on the output signal of the encoder 109, the control portion 150 determines that the retard roller 104 is under acceleration or under deceleration (unstable area). This situation is illustrated in FIG. 7. FIG. 7 illustrates the output signal of the encoder 109, and the absolute value (the state zone average) of the angular acceleration of the rotation frequency of the retard roller 104 based on the output signal. In the stable area where the absolute value of the angular acceleration is small, a pulse signal having a uniform width is output. On the other hand, in the unstable area where the absolute value of the angular acceleration is large, the width of the pulse signal varies. Further, the sheet that is precedingly fed is referred to as the preceding sheet (a first sheet), and the subsequent sheet that is fed following the preceding sheet is referred to as the next sheet (a second sheet). Further, the subsequent sheet that is fed following the next sheet is referred to as the next next sheet (a third sheet). Further, the feeding operation refers to the operation for a single sheet after feeding is started by the pick-up roller 101 (from the state zone 4) until the trailing edge of the sheet that was fed passes the separation nip portion 102 (until the next state zone 4). Therefore, in FIG. 6A, the state zone 1 to state zone 4 corresponds to the feeding operation of the preceding sheet, and the same state zone 4 to the next state zone 4 corresponds to the feeding operation of the next sheet.

State Zone 1

In the state zone 1, the leading edge position and trailing edge position of the preceding sheet and the next sheet are as follows:

the preceding sheet leading edge position is more downstream than the conveyance roller 105;

the preceding sheet trailing edge position is more upstream than the pick-up roller 101 by X mm (see FIG. 6C); and the next sheet is inside the feeding cassette 106.

Additionally, each roller, the encoder 109, and the electromagnetic clutch 112 are as follows:

the retard roller 104 behaves corotating with the preceding sheet (the broken-line arrow), and performing normal rotation with respect to the feeding direction;

the feed roller 103 behaves corotating with the preceding sheet (the broken-line arrow), and performing normal rotation with respect to the feeding direction; and the pick-up roller 101 is separated from the preceding sheet, performing normal rotation with respect to the feeding direction. Further, since the electromagnetic clutch 112 is turned OFF as described later, the arrow in the normal rotation direction is illustrated with a broken line.

In the detection result based on the output signal of the encoder 109, it is detected that the retard roller 104 is performing normal rotation and is stable. Further, the control portion 150 cannot determine whether the retard roller 104 is performing normal rotation or reverse rotation only from the output signal of the encoder 109. However, the control portion 150 manages, with the counter, the state zones in which the retard roller 104 can only perform normal rotation and the state zones in which the retard roller 104 can only perform reverse rotation. Thus, the control portion 150 can determine whether the retard roller 104 is performing normal rotation or reverse rotation.

In the electromagnetic clutch 112 (feeding signal), after the preceding sheet leading edge passes the conveyance roller 105, the electromagnetic clutch 112 is turned OFF, and driving and coupling is canceled.

State Zone 2

In the state zone 2, the leading edge position and trailing edge position of the preceding sheet and the next sheet are as follows:

preceding sheet leading edge position is more downstream than the conveyance roller 105;

preceding sheet trailing edge position: between the position that is X mm upstream of the pick-up roller 101 and the separation nip portion 102; and the next sheet is inside the feeding cassette 106.

Additionally, each roller, the encoder 109, and the electromagnetic clutch 112 are as follows:

the retard roller 104 behaves corotating with the preceding sheet (the broken-line arrow), and performing normal rotation with respect to the feeding direction; and the feed roller 103 behaves corotating with the preceding sheet (the broken-line arrow), and performing normal rotation with respect to the feeding direction.

The pick-up roller 101 behaves contacting the preceding sheet after a predetermined time t2 passes since the feeding signal of the preceding sheet is turned ON. The predetermined time t2 is determined according to the set sheet length. That is, the predetermined time t2 is determined based on the time for the trailing edge of the preceding sheet to pass the position that is more upstream in the feeding direction than the position at which the pick-up roller 101 contacts the preceding sheet (hereinafter referred to as the contacting position) by a predetermined distance X mm. In other words, the predetermined time t2 can be said to be the time required for the position more downstream in the feeding direction than the trailing edge of the preceding sheet by the predetermined distance X mm to pass the pick-up roller 101. When the sheet length is short, the time for the trailing edge of the sheet to pass the predetermined distance X mm that is more upstream in the feeding direction than the contacting position after feeding of the sheet is started becomes short. On the other hand, when the sheet length is long, the time for the trailing edge of the sheet to pass the predetermined distance X mm that is more upstream in the feeding direction than the contacting position after feeding of the sheet is started becomes longer than the case where the sheet length is short. Note that the sheet length is the length of the sheet S in the feeding direction.

The circumferential speed of the feed roller 103 is set to be faster than the circumferential speed of the pick-up roller 101. Therefore, in the state zone 2, the conveyance speed of the preceding sheet is faster than the circumferential speed of the pick-up roller 101. Additionally, the one-way clutch is housed in the one-way clutch gear 114. Thus, in the state zone 2, the pick-up roller 101 corotates with the preceding sheet (the broken-line arrow) and performs idle rotation.

In the detection result based on the output signal of the encoder 109, it is detected that the retard roller 104 is performing normal rotation and is stable.

In the electromagnetic clutch 112 (feeding signal), the electromagnetic clutch is turned OFF, and driving is not coupled.

The pick-up roller 101 contacts the preceding sheet before the feeding signal of the next sheet is turned ON, thereby minimizing the time in which the sheet is fed after the feeding signal of the next sheet is received. The pick-up roller 101 contacts the preceding sheet when the preceding sheet is fed from the feeding cassette 106. The pick-up roller 101 is separated from the preceding sheet when the leading edge of the preceding sheet passes the separation nip portion 102. The pick-up roller 101 contacts the preceding sheet again (contacts the first sheet again) at the timing when the trailing edge of the preceding sheet passes the position that is in the direction opposite to the feeding direction by the predetermined distance (the above-described X mm) from the position at which the pick-up roller 101 contacts the preceding sheet.

State Zone 3

In the state zone 3, the leading edge position and trailing edge position of the preceding sheet and the next sheet are as follows:

preceding sheet leading edge position is more downstream than the conveyance roller 105;

preceding sheet trailing edge position is immediately after passing the separation nip portion 102; and the next sheet is inside the feeding cassette 106. Additionally, each roller, the encoder 109, and the electromagnetic clutch 112 are as follows:

the retard roller 104 behaves, with the impact caused by the trailing edge of the preceding sheet passing the separation nip portion 102, such that the retard roller 104 is vibrated in the arrow Y2 directions about the retard roller oscillation center 104*c* as the oscillation center with respect to the feed roller 103, and the rotation becomes unstable (the circles illustrated by the continuous line and a broken line in the figure).

The feed roller 103 behaves as not being driven, and since the rotation of the retard roller 104 is unstable, the rotation of the feed roller 103 also becomes unstable.

The pick-up roller 101 behaves contacting the next sheet and not rotating. In the detection result based on the output signal of the encoder 109, the unstable normal rotation (a dotted line) or the unstable reverse rotation (the continuous line) of the retard roller 104 is detected.

The electromagnetic clutch 112 (feeding signal) 112 is turned OFF, and not coupled for driving.

State Zone 4

In the state zone 4, the leading edge position and trailing edge position of the preceding sheet and the next sheet are as follows:

preceding sheet leading edge position is more downstream than the conveyance roller 105;

preceding sheet trailing edge position is more downstream than the separation nip portion 102; and the next sheet is inside the feeding cassette 106.

Additionally, each roller, the encoder 109, and the electromagnetic clutch 112 are as follows:

the retard roller 104 behaves such that the vibration of the retard roller 104 is converged, and is stabilized in reverse rotation (the continuous-line arrow) equal to or more than a predetermined rotation frequency.

The feed roller 103 behaves corotating with the retard roller 104 (the broken-line arrow), and performing reverse rotation.

The behavior of the pick-up roller 101 behaves contacting the next sheet but not rotating. In the detection result based on the output signal of the encoder 109, the retard roller 104 is stable in reverse rotation.

The electromagnetic clutch 112 (feeding signal) is turned OFF, and not coupled for driving.

State Zone 5

In the state zone 5, the leading edge position and trailing edge position of the preceding sheet and the next sheet are as follows:

preceding sheet leading edge position: more downstream than the conveyance roller 105;

preceding sheet trailing edge position: more downstream than the separation nip portion 102; and the next sheet leading edge position is more upstream than the separation nip portion 102. Additionally, each roller, the encoder 109, and the electromagnetic clutch 112 are as follows:

the retard roller 104 behaves such that, since the feed roller 103 performs normal rotation (the continuous-line arrow), the retard roller 104 corotates with the feed roller 103 (the broken-line arrow), and is under acceleration in normal rotation. Note that, in FIG. 6A, under acceleration is also written in the unstable column.

The feed roller 103 behaves performing normal rotation (the continuous-line arrow).

The pick-up roller 101 behaves contacting the next sheet, and performing normal rotation driving (the continuous-line arrow), and feeding the next sheet.

In the detection result based on the output signal of the encoder 109, it is detected that the retard roller 104 is under acceleration in normal rotation.

The electromagnetic clutch 112 (feeding signal) is turned ON, on the basis of the fact that the detection result based on the output signal of the encoder 109 becomes "reverse rotation stable." Alternatively, the feeding signal may be sent by estimating the timing at which reverse rotation stable is achieved from the waveform of the output signal of the encoder 109, considering the time until the sheet S is actually fed after starting the turning ON of the feeding signal, and subtracting the time from the timing at which the reverse rotation stable is achieved.

State Zone 6

In the state zone 6, the leading edge position and trailing edge position of the preceding sheet, and the next sheet are as follows:

preceding sheet leading edge position is more downstream than the conveyance roller 105;

preceding sheet trailing edge position is more downstream than the separation nip portion 102; and the next sheet leading edge position: between a position more downstream than the separation nip portion 102 and the position of the conveyance roller 105.

Additionally, each roller, the encoder 109, and the electromagnetic clutch 112 are as follows:

the retard roller 104 behaves, when the next sheet is not in double feeding, corotating with the next sheet (the broken-line arrow), and performing normal rotation with respect to the feeding direction, and when the next sheet is in double feeding, performing reverse rotation with respect to the feeding direction (the continuous-line arrow) ("behavior in double feeding" illustrated by a broken line in FIG. 6A).

The feed roller 103 behaves performing normal rotation (the continuous-line arrow).

The pick-up roller 101 is separated from the next sheet after a predetermined time t1 (t1<t2) passes since the feeding signal of the next sheet is turned ON, and after the leading edge of the next sheet that is being fed passes the separation nip portion 102.

In the detection result based on the output signal of the encoder 109, when the next sheet is not in double feeding, it is detected that the retard roller 104 is performing normal rotation and is stable (the continuous line). When the next sheet is in double feeding, it is detected that the retard roller 104 is performing reverse rotation ("behavior in double feeding" illustrated by the broken line). Note that, since there is a case where double feeding is canceled during the state zones 5 and 6, and the retard roller 104 transitions from reverse rotation to normal rotation, "under acceleration" is also illustrated by the broken line in FIG. 6A.

The electromagnetic clutch 112 (feeding signal) is turned ON, and coupled for driving.

(Other Design Requirements)

As for the behavior of the retard roller 104 in the case where feeding is started and the sheet S is in double feeding, as illustrated by the broken line from the state zone 5 to the state zone 1 in FIG. 6A, when a sheet bundle is being separated, the retard roller 104 performs reverse rotation, and when the separation ends, the retard roller 104 corotates with the normal rotation of the feed roller 103. Therefore, the configuration is adopted in which the feeding of the next next sheet is not started during the reverse rotation operation of the retard roller 104 at the time of a sheet bundle separation. That is, the feeding prohibition state zone (duration) for prohibiting the feeding of the next next sheet is provided from the start of the state zone 5 for sending in which the feeding signal of the next sheet is turned ON until the start of the state zone 2 in which the pick-up roller 101 contacts the trailing edge of the next sheet. FIG. 6A also illustrates (a part of) the feeding prohibition state zone of the next sheet during the feeding operation of the preceding sheet.

When the length (the sheet length) in the feeding direction of the sheet S that is set in advance is longer than the actual sheet length, there is a case where the detection result based on the output signal of the encoder 109 detects the reverse rotation stable over the state zone 1 and state zone 2. When feeding is started based on this detection result, the distance between the sheets becomes unnecessarily long, and the optimum throughput is not achieved. Therefore, the control portion 150 measures the time for reverse rotation stable by, for example, a timer (not shown), and when the time for the reverse rotation stable is longer than the time for reverse rotation stable assumed based on the sheet length, the control portion 150 does not start feeding and stops printing. Then, the control portion 150 displays the disagreement between the set sheet length and the actual sheet length on a display unit 121, thereby reporting the disagreement to a user. Additionally, when the printer 1 is configured to automatically detect the sheet length at the position of the sheet trailing edge regulating portion 120, the control portion 150 displays the information on the display unit 121 to prompt the correction of the position of the sheet trailing edge regulating portion 120, thereby reporting the information to the user.

After the reverse rotation of the retard roller 104 is stabilized in this manner, and the vibration is converged (after the timing at which the vibration is converged), feeding of the next sheet is started. Accordingly, the optimum distance between the sheets is achieved according to the conditions of the sheet feeding apparatus used. As a result, deterioration in the feeding performance due to the fact that the distance between the sheets at the time of feeding is too narrow is not caused, and feeding can be performed with the shortest distance between the sheets. Thus, productivity improvement can be achieved. In Example 1, the feed motor 110 is controlled to make the pick-up roller 101 to perform feeding of the first sheet. After the trailing edge of the first sheet passes the separation nip portion 102, based on the signal output from the encoder 109, the timing at which the second sheet following the first sheet is fed by the pick-up roller 101 is changed. As described above, according to Example 1, the improvement of productivity can be achieved, without causing a deterioration in the feeding performance.

Example 2

Figure 8A:
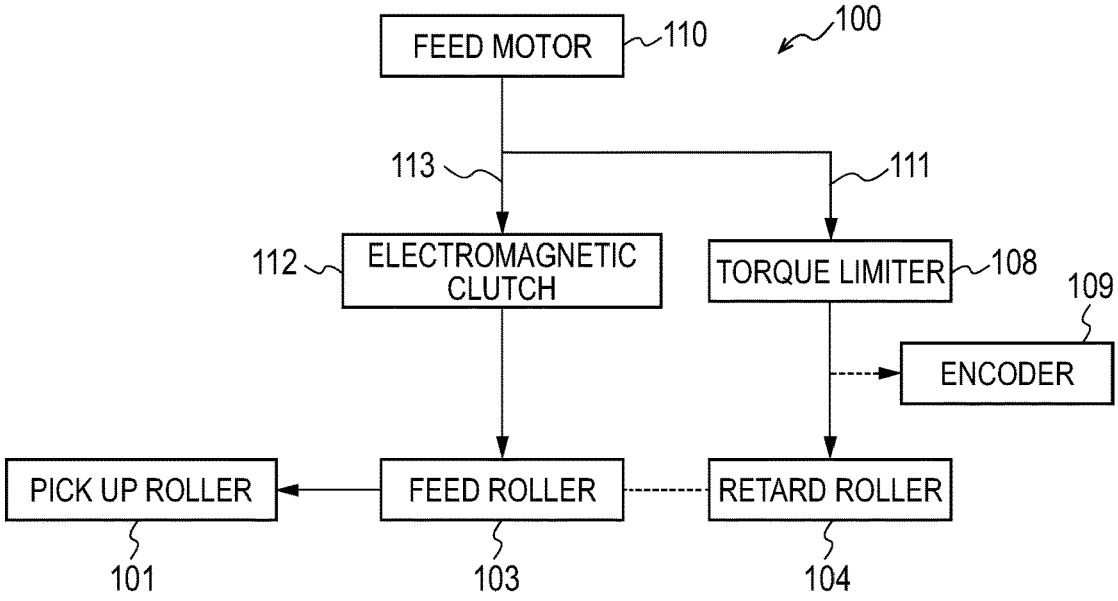
FIGS. 8A, 8B and 8C are schematic diagrams of the driving column of the sheet feeding unit 100 of Example 2.
Figure 8B:
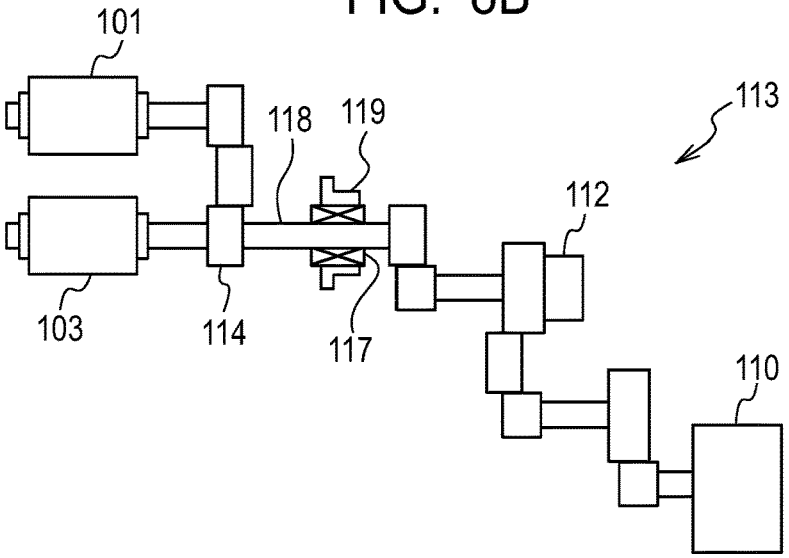
Figure 8C:
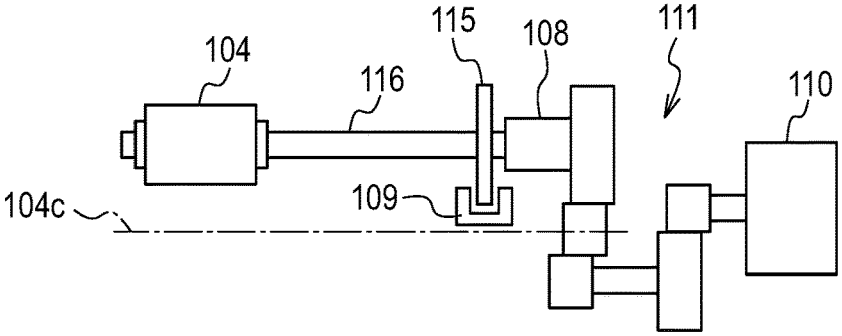

Next, Example 2 is described by using FIGS. 8A to 8C. FIG. 8A is a block diagram for describing transmission of a driving force, FIGS. 8B and 8C are side views for describing transmission of the driving force from the driving source to each roller. Example 2 includes a bearing 119 and one-way clutch 117 in addition to Example 1. The bearing 119 is unrotatably supported by the apparatus main body, and the one-way clutch 117 is unrotatably supported by the bearing 119. Then, the one-way clutch 117 pivotally supports a feed shaft 118 including the feed roller 103, and is set to prohibit the rotation of the feed roller 103 in the direction of reverse rotation with respect to the feeding direction. As a result, even if the retard roller 104 is driven to perform reverse rotation, the feed roller 103 does not perform reverse rotation. Additionally, when the friction coefficient between the contacting roller surfaces of the retard roller 104 and the feed roller 103 is more than a certain value, the reaction force of the feed roller 103 with respect to the rotation force of the retard roller 104 becomes larger than the drive transmission force of the torque limiter 108. Therefore, the retard roller 104 does not rotate. Note that, since the other configurations are the same as those in Example 1, the same reference numerals are assigned to the same configurations, and a detailed description for such configurations is omitted.

<A Series of Operations of the Sheet Feeding Unit 100 during Continuous Feeding>

Figure 9A:
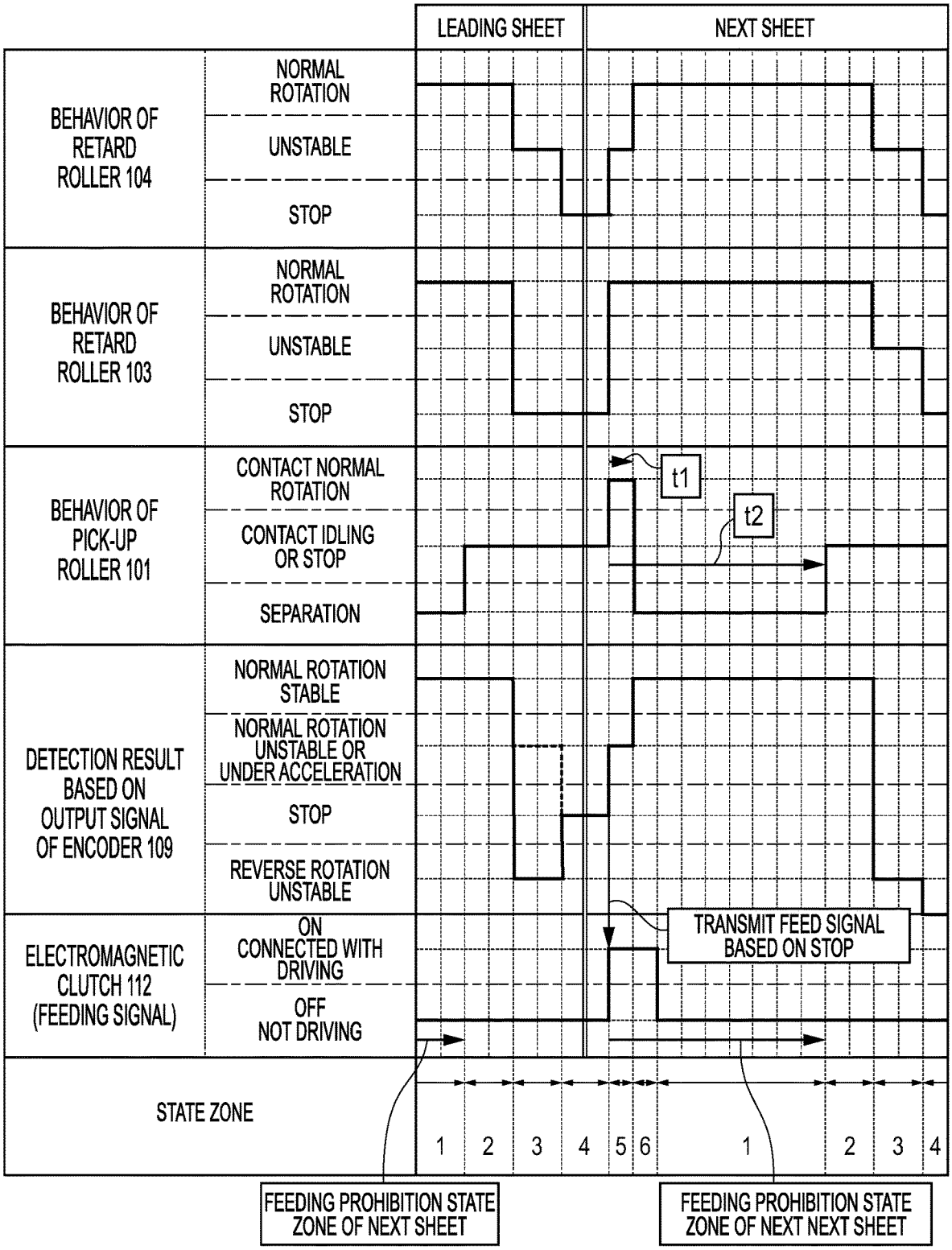
FIGS. 9A, 9B, 9C, 9D, 9E, 9F and 9G are explanatory diagrams of a series of operations of the sheet feeding unit 100 of Example 2.
Figure 9B:
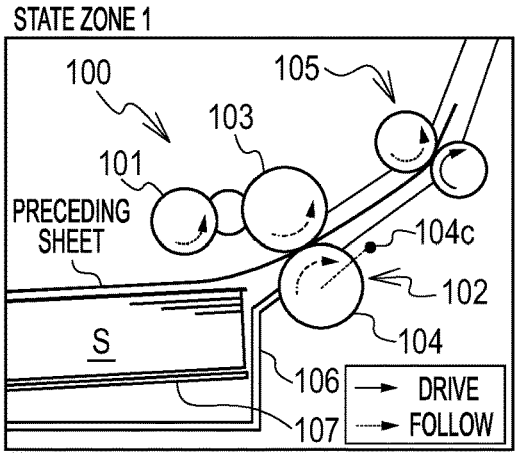
Figure 9C:
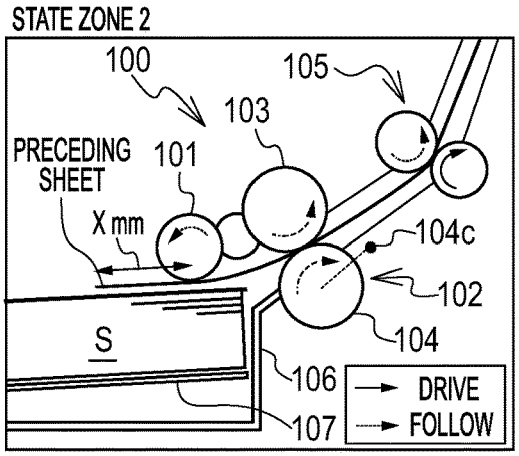
Figure 9D:
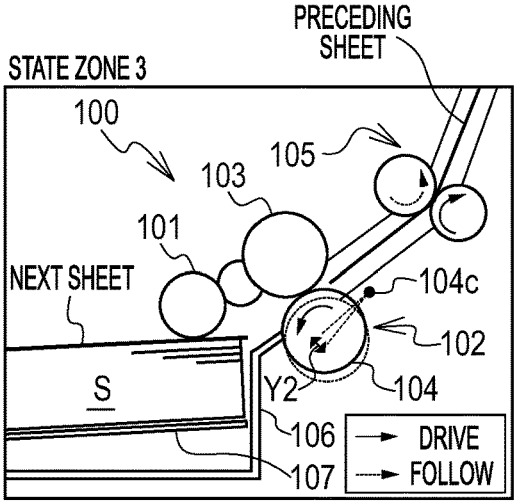
Figure 9E:
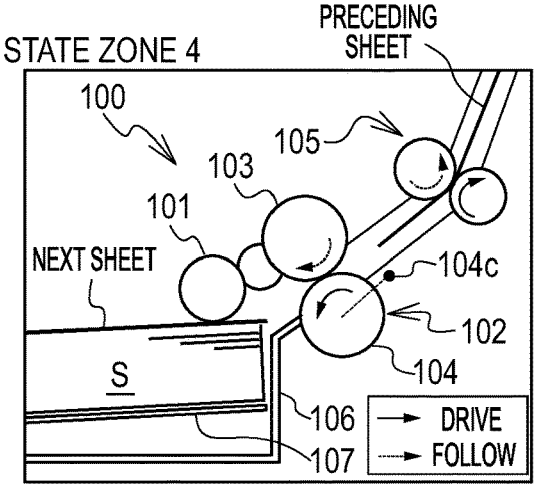
Figure 9F:
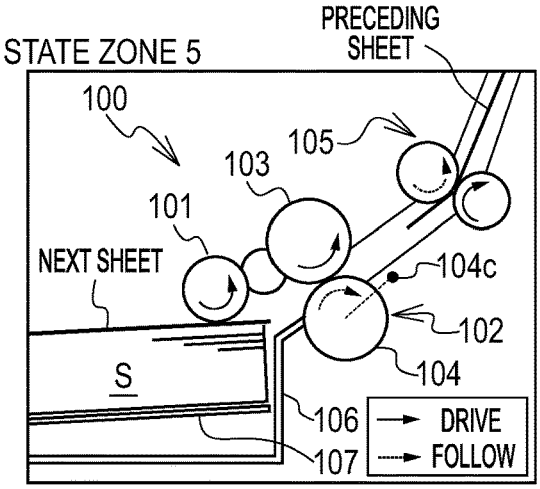
Figure 9G:
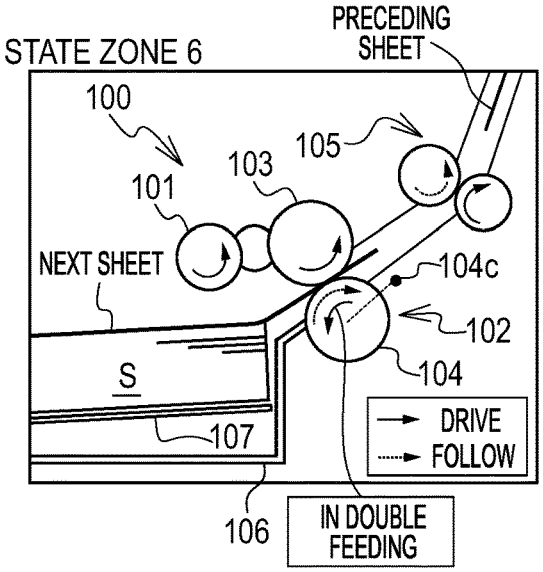

Using FIGS. 9A to 9G, the time is described by dividing the time into state zones. Note that, since FIGS. 9A and 9B are similar to FIGS. 6A and 6B, a description of how to see the figures is omitted. Further, in the behavior of the retard roller 104, there is "stop" (FIG. 9A) instead of "reverse rotation" (FIG. 6A). Additionally, since the feed roller 103 cannot rotate in the direction of reverse rotation, in the behavior of the feed roller 103, there is "stop" (FIG. 9A) instead of "reverse rotation" (FIG. 6A). Further, as for the detection result based on the output signal of the encoder 109, there is "reverse rotation unstable" (FIG. 9A) instead of "reverse rotation unstable or under acceleration" and "reverse rotation stable" (FIG. 6A)

State Zone 1 to State Zone 2

Because the state zones 1 and 2 are the same as those in Example 1, a description of those is omitted.

State Zone 3

In the state zone 3, the leading edge position and trailing edge position of the preceding sheet and the next sheet are as follows:

preceding sheet leading edge position is more downstream than the conveyance roller 105;

preceding sheet trailing edge position is immediately after passing the separation nip portion 102; and the next sheet is inside the feeding cassette 106.

Additionally, each roller, the encoder 109, and the electromagnetic clutch 112 are as follows:

the retard roller 104 behaves, with the impact caused by the trailing edge of the preceding sheet passing the separation nip portion 102, such that the retard roller 104 is vibrated in the arrow Y2 directions about the retard roller oscillation center 104*c* as the oscillation center with respect to the feed roller 103, and the rotation becomes unstable.

The feed roller 103 is not driven, and the feed roller 103 does not perform reverse rotation due to the one-way clutch 117. Thus, the feed roller 103 stops.

The pick-up roller 101 behaves contacting the next sheet but not rotating.

In the detection result based on the output signal of the encoder 109, unstable normal rotation illustrated by the broken line of the retard roller 104 or the unstable reverse rotation illustrated by the continuous line is detected.

The electromagnetic clutch 112 (feeding signal) is turned OFF, and not coupled for driving.

State Zone 4

In the state zone 4, the leading edge position and trailing edge position of the preceding sheet and the next sheet are as follows:

preceding sheet leading edge position is more downstream than the conveyance roller 105;

preceding sheet trailing edge position: more downstream than the separation nip portion 102; and the next sheet is inside the feeding cassette 106.

Additionally, each roller, the encoder 109, and the electromagnetic clutch 112 are as follows:

the retard roller 104 behaves such that the vibration of the retard roller 104 is converged, and the rotation is stopped by the configuration of Example 2.

The feed roller 103 behaves stopping.

The pick-up roller 101 behaves contacting the next sheet but not rotating.

In the detection result based on the output signal of the encoder 109, the stop of the retard roller 104 is detected.

The electromagnetic clutch 112 (feeding signal) is turned OFF, and not coupled for driving.

State Zone 5

In the state zone 5, the leading edge position and trailing edge position of the preceding sheet and the leading edge position of the next sheet are as follows:

preceding sheet leading edge position is more downstream than the conveyance roller 105;

preceding sheet trailing edge position is more downstream than the separation nip portion 102; and the next sheet leading edge position is more upstream than the separation nip portion 102.

Additionally, each roller, the encoder 109, and the electromagnetic clutch 112 are as follows:

the retard roller 104 behaves, when the feed roller 103 performs normal rotation, such that the retard roller 104 corotates with the feed roller 103, and is under acceleration in normal rotation from the stop state in the state zone 4. Therefore, in FIG. 8A, it is indicated as "unstable";

the feed roller 103 performs normal rotation;

the pick-up roller 101 behaves contacting the next sheet, driven to perform normal rotation, and feeding the next sheet; and in the detection result based on the output signal of the encoder 109, it is detected that the retard roller 104 is under acceleration in normal rotation.

The electromagnetic clutch 112 (feeding signal) is turned ON, on the basis of the fact that the detection result based on the output signal of the encoder 109 is stop. Alternatively, the feeding signal may be turned ON by estimating the timing for stop from the waveform of the output signal of the encoder 109, considering the time until the sheet S is actually fed after the feeding signal is turned ON, and subtracting the time from the timing for stop.

State Zone 6

In the state zone 6, the leading edge position and trailing edge position of the preceding sheet, and the leading edge position of the next sheet are as follows:

preceding sheet leading edge position: more downstream than the conveyance roller 105;

preceding sheet trailing edge position: more downstream than the separation nip portion 102; and the next sheet leading edge position: between a position more downstream than the separation nip portion 102 and the position of the conveyance roller 105.

Additionally, each roller, the encoder 109, and the electromagnetic clutch 112 are as follows:

the retard roller 104 behaves when the next sheet is not in double feeding, corotating with the next sheet, and performing normal rotation with respect to the feeding direction. When the next sheet is in double feeding, performing reverse rotation with respect to the feeding direction. Note that, since "reverse rotation" is not illustrated in FIG. 9A, the case of double feeding is not illustrated.

The feed roller 103 performs normal rotation.

The pick-up roller 101 is separated from the next sheet after the predetermined time t1 (t1<t2) from the turning ON of the feeding signal of the next sheet, and after the preceding sheet leading edge that is being conveyed passes the separation nip portion 102.

In the detection result based on the output signal of the encoder 109, when the next sheet is not in double feeding, it is detected that the retard roller 104 is performing normal rotation and is stable. When the next sheet is in double feeding, it is detected that the retard roller 104 is performing reverse rotation. Note that, since the "reverse rotation stable" is not illustrated in FIG. 9A, the case of double feeding is not illustrated.

The electromagnetic clutch 112 (feeding signal) is turned ON, and coupled for driving.

(Other Design Requirements)

The friction coefficients of the roller surfaces of the feed roller 103 and the retard roller 104 are decreased due to scratch of the roller surfaces as the rollers are used for a while, and adhesion of paper powders on the roller surfaces. When the friction coefficient is less than a certain value, in the state zone 4, the retard roller 104 may not stop and perform reverse rotation. In that case, the encoder 109 cannot detect the stop of the retard roller 104, and feeding is never started. Therefore, as a countermeasure for that case, even if the feeding signal is not turned ON, the control portion 150 forcibly starts feeding after a predetermined time t3, which is a third time on the basis of the start of feeding of the preceding sheet, has passed. When this forced feeding successively occurs for a predetermined number of times, the control portion 150 may display the information to prompt exchange of the feed roller 103 and the retard roller 104, etc. on the display unit 121.

In Example 2, feeding of the next sheet is started after vibration is converged substantially simultaneously when the rotation of the retard roller 104 is stopped. Therefore, the same effect as in Example 1 can be obtained. As described above, according to Example 2, the improvement of productivity can be achieved, without causing a deterioration in the feeding performance.

Example 3

<Configuration of Separation Portion>

Figure 10:
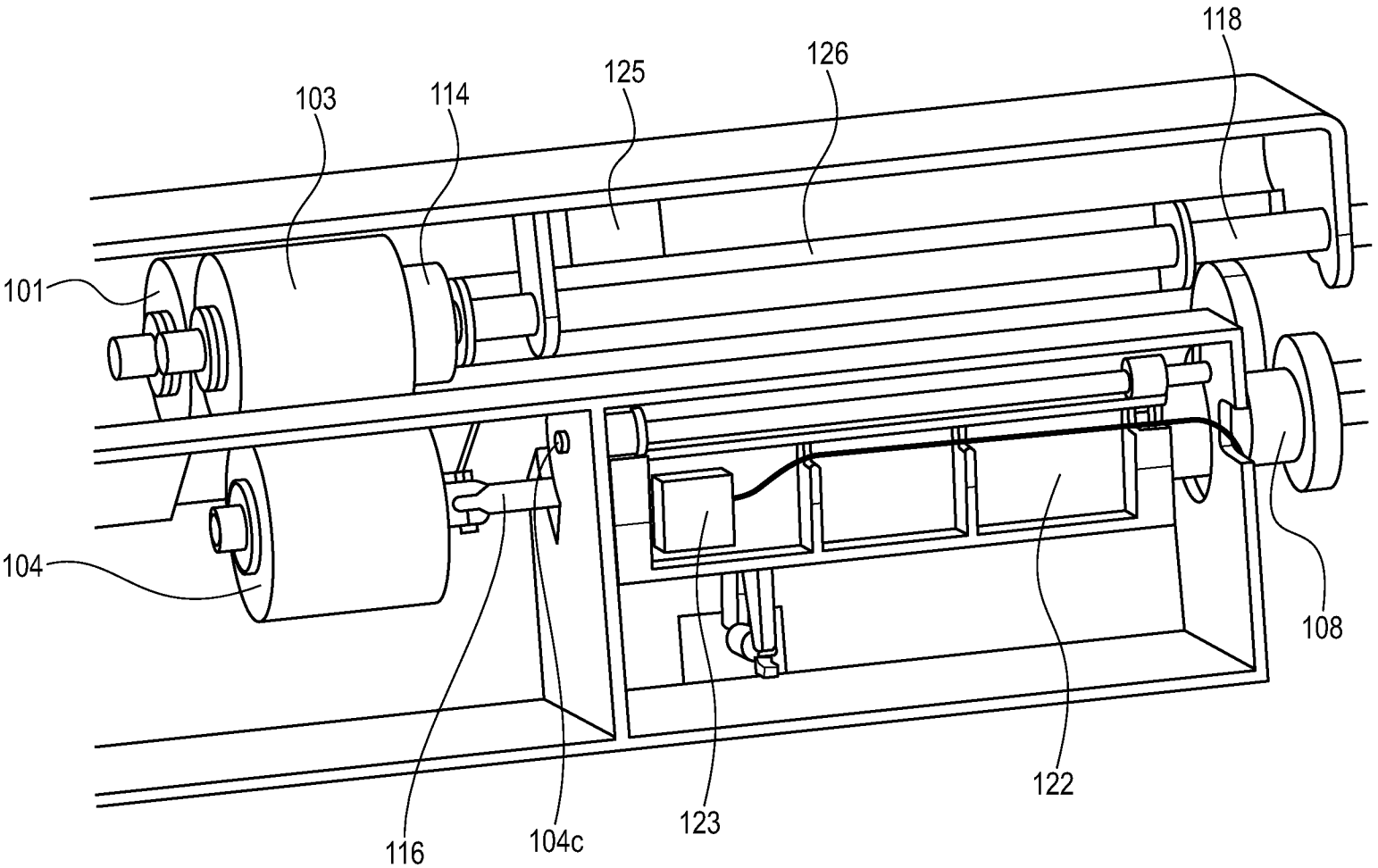
FIG. 10 is a perspective view of the sheet feeding unit 100 of Example 3.

Next, Example 3 is described. The same reference numerals are assigned to the same configurations as those in Example 1, and a detailed description for such configurations is omitted. FIG. 10 is a diagram illustrating the configuration of the separation nip portion 102 of Example 3. As illustrated in FIGS. 9A and 9B, comparing with Example 1 and Example 2, instead of the code wheel 115 and the encoder 109, which are the detection unit of the retard roller 104, Example 3 is configured as follows. That is, in Example 3, a retard holder 122 holding the retard roller 104, the retard axis 116, and the torque limiter 108, with the retard roller oscillation center 104*c* serving as the oscillation center, is provided with an acceleration sensor 123, which is a detection unit for detecting acceleration. In Example 3, unstable vibration of the retard roller 104 in the state zone 3 is detected by the acceleration sensor 123. The control portion 150 determines that the unstable vibration of the retard roller 104 is converged and stabilized, based on the detection result of the acceleration sensor 123.

<A Series of Operations of Sheet Feeding Unit 100 during Continuous Feeding>

Figure 11:
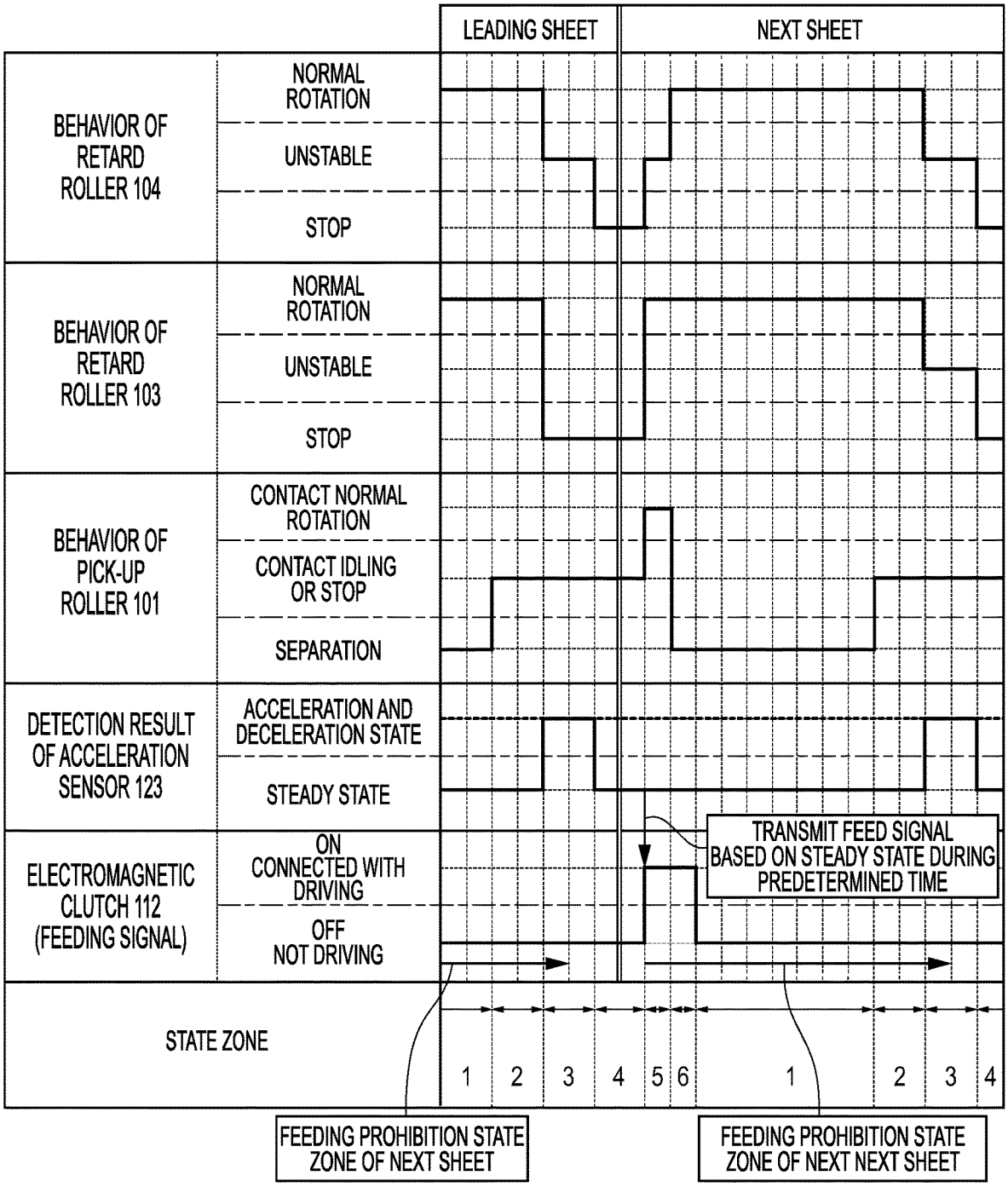
FIG. 11 is an explanatory diagram of a series of operations of the sheet feeding unit 100 of Example 3.

Using FIG. 11, a series of operations are described by dividing the time into state zones. Note that, though FIG. 11 is a figure similar to FIG. 9A, "detection result based on output signal of encoder 109" in FIG. 9A is replaced with "detection result of acceleration sensor 123." The detection result of the acceleration sensor 123 includes states of "acceleration and deceleration state" and "steady state." Additionally, the behaviors of other rollers except the detection result of the acceleration sensor 123 are similar to those of FIG. 8A, and a description of the behaviors is omitted. In Example 1 and Example 2, the control portion 150 turns ON the feeding signal on the basis of the detection result based on the output signal output by the encoder 109 according to the rotation state of the retard roller 104. Meanwhile, in Example 3, the control portion 150 turns ON the feeding signal on the basis of the fact that the absolute value of the acceleration detected based on the detection result of the acceleration sensor 123 in the state zone 4 becomes equal to or smaller than a predetermined value, i.e., that the steady state is maintained during a predetermined time.

In Example 1 and Example 2, the feeding prohibition state zone (see FIG. 6A) for the next next sheet is provided from the start of the state zone 5 in which the feeding signal for feeding the next sheet is sent until the start of the state zone 2 in which the pick-up roller 101 contacts the trailing edge of the next sheet. In Examples 1 and 2, detection is performed by the detection result based on the output signal of the encoder 109 (for example, normal/reverse rotation, angular velocity, etc.) according to the state of the retard roller 104. However, in Example 3, the acceleration sensor 123 is provided in the retard holder 122, and "acceleration and deceleration state" or "steady state" is detected. Therefore, in Example 3, there is also a case where the acceleration sensor 123 is in the steady state from the state zone 5 to the state zone 2 of the next sheet. In such a case, start of feeding of the next sheet after the next sheet also occurs before the trailing edge of the next sheet passes the separation nip portion 102. Therefore, in Example 3, the feeding prohibition state zone of the next next sheet is set from the state zone 5 of the next sheet to the start of the state zone 3 in which the trailing edge of the next sheet positively passes the separation nip portion 102. This feeding prohibition state zone (close time) of the next sheet after the next sheet is determined based on the sheet length in the feeding direction of the sheet S that is set.

Additionally, in Example 1 and Example 2, the retard roller 104 is driven to perform reverse rotation with respect to the feeding direction. However, in Example 3, the acceleration is detected by the acceleration sensor 123 in the arrow Y2 directions. Thus, it is unnecessary to drive the retard roller 104 to perform reverse rotation.

Since feeding is started after the vibration of the retard roller 104 is converged based on the detection result of the acceleration sensor 123 in this manner, the same effect as in Example 1 can be obtained. As described above, according to Example 3, the improvement of productivity can be achieved, without causing a deterioration in the feeding performance.

Example 4

Next, Example 4 is described. In Example 1 to Example 3, the rotation or vibration of the retard roller 104 is detected, and feeding of the next sheet is started based on the detection result. That is, the interval from the start of feeding of the preceding sheet to the start of feeding of the next sheet is not a constant time. On the other hand, in Example 4, the interval from the start of feeding of the preceding sheet to the start of feeding of the next sheet is a constant time.

Figure 12A:
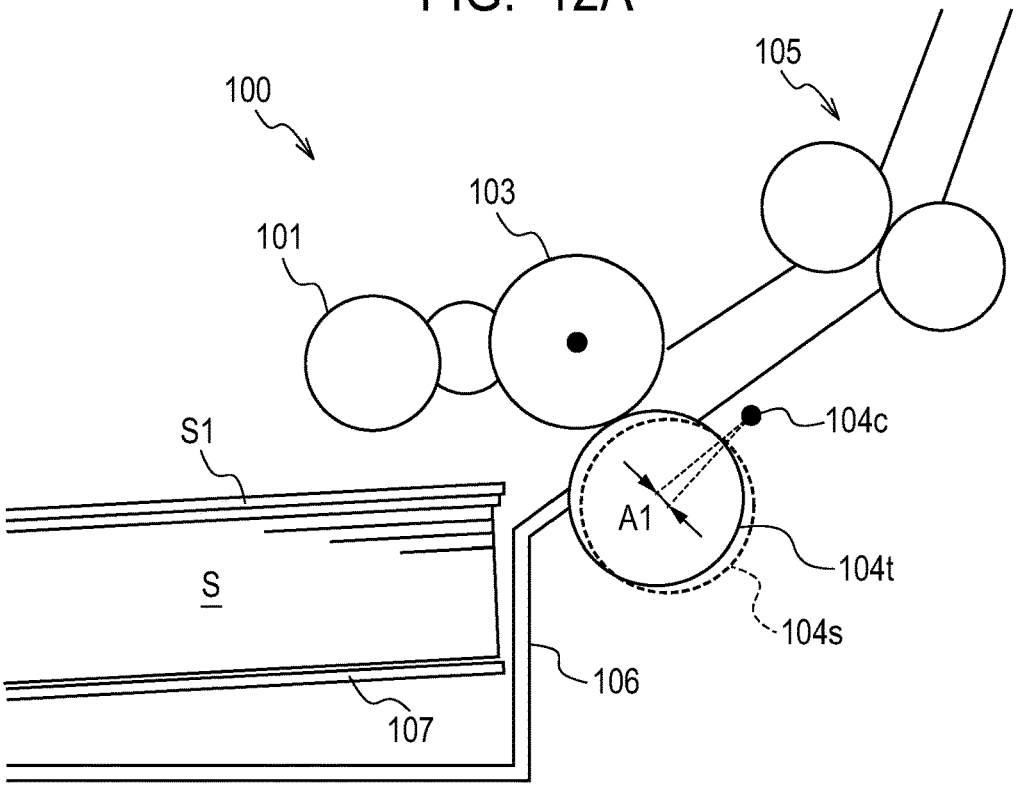
FIGS. 12A and 12B are cross-sectional views of the sheet feeding unit 100 of Example 4.
Figure 12B:
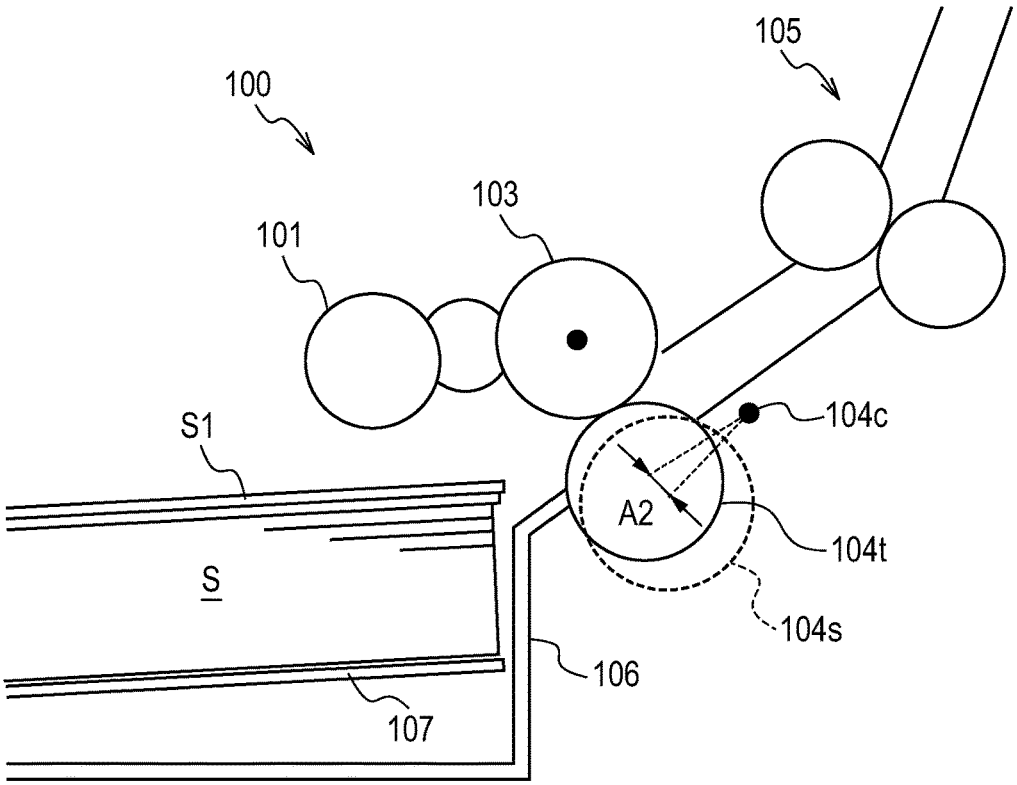
Figure 13A:
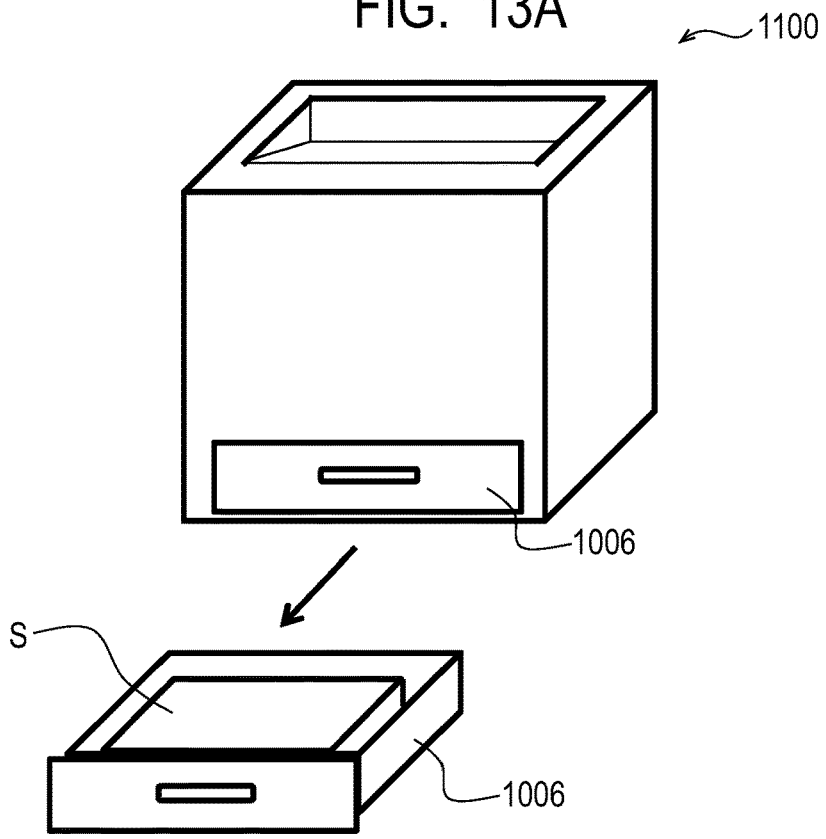
FIGS. 13A and 13B are a general perspective view illustrating an image forming apparatus of a conventional example, and a cross-sectional view of a sheet feeding unit 1000, respectively.
Figure 13B:
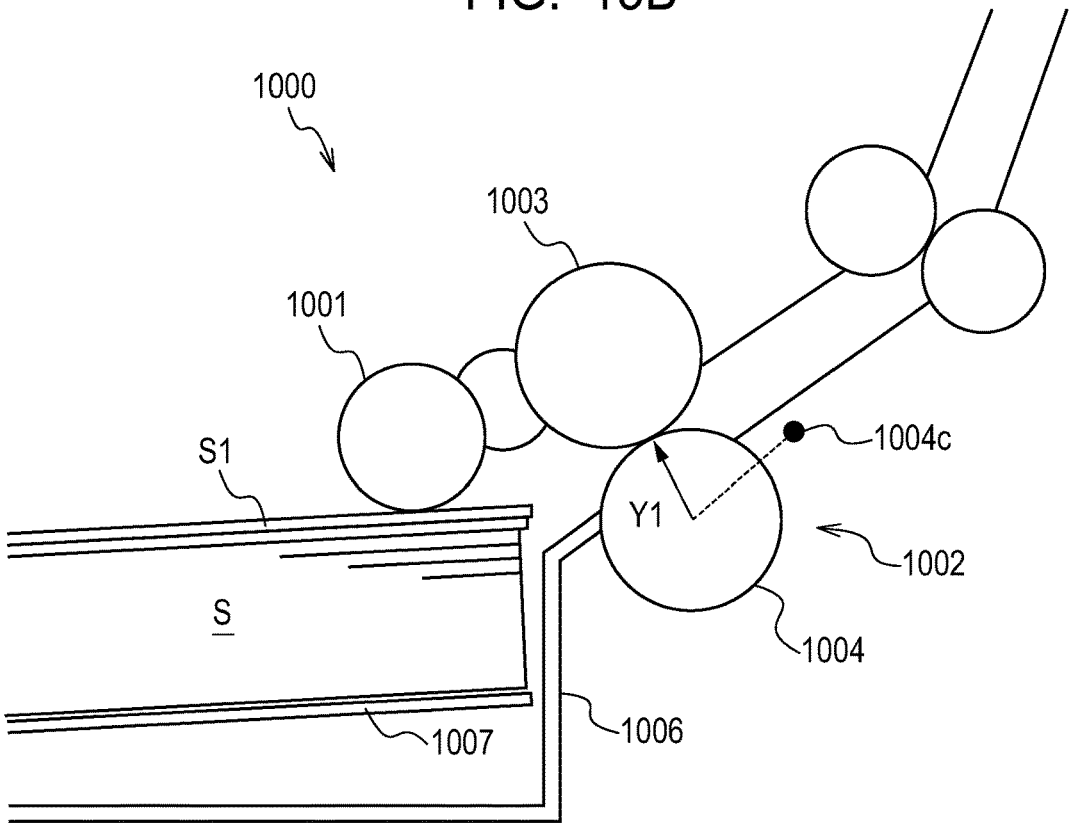

FIG. 12A is a diagram illustrating the state where the sheet feeding unit 100 is not used much, and FIG. 12B is a diagram illustrating the state where the sheet feeding unit 100 has been used for a while. The same reference numerals are assigned to the same configurations as those in Example 1. Additionally, a retard roller 104*s* illustrates the retard roller 104 at the time when the retard roller 104 is oscillated and at the position (hereinafter referred to as the oscillation stop position) most distant from the feed roller 103. A retard roller 104*t* illustrates the retard roller 104 at the time when the retard roller 104 is at a position at which the retard roller 104 contacts the feed roller 103. As illustrated in FIG. 12A or FIG. 12B, when the sheet feeding unit 100 has been used for a while, the roller diameters of the feed roller 103 and the retard roller 104 become small. Noted that being used for a while is hereinafter referred to as durability. Therefore, the oscillation angles of the retard roller 104*s* at the oscillation stop position and the retard roller 104*t* contacting the feed roller 103 are as follows:

before durability A1<after durability A2.

Here, before durability A1 is the oscillation angle of the retard roller 104*s* and the retard roller 104*t* in the state where the rollers are not used much. After durability A2 is the oscillation angle of the retard roller 104*s* and the retard roller 104*t* in the state where the rollers are used for a while.

As a result, when used for a while, the vibration of the retard roller 104 is converged, and the time until the rotation is stabilized will be extended. Therefore, when the interval from the start of feeding of the preceding sheet to the start of feeding of the next sheet is set to be a certain time, the vibration of the retard roller 104 has not converged yet within the certain time, feeding of the next sheet is started at the timing at which the rotation is unstable, and feeding failures may tend to occur. As the countermeasure, in Example 4, when the vibration of the retard roller 104 has not converged and the rotation is not stable at the time of the start of feeding after a certain time has passed, the control portion 150 is set not to start feeding of the next sheet, but to start feeding after the vibration is converged and the rotation is stabilized. In this manner, the start of feeding of the next sheet is changed according to the used hours of the retard roller 104. That is, when the vibration of the retard roller 104 is converged within a certain time, the next sheet is fed at the timing when the certain time has passed. Then, when the vibration of the retard roller 104 is not converged within the certain time, the next sheet is fed at the timing after a certain time has passed in which the vibration of the retard roller 104 is converged.

Additionally, in that case, the control portion 150 displays that exchange of the feed roller 103 and the retard roller 104 is necessary on the display unit 121, thereby reporting the necessity to the user. As a result, though the throughput is decreased, the exchange timing of the feed roller 103 and the retard roller 104 can be delayed, while reducing feeding failures caused by starting feeding of the next sheet during the vibration of the retard roller 104. Accordingly, the down time until the user purchases and exchanges the replacement parts such as the feed roller 103 and the retard roller 104 can be eliminated. As described above, according to Example 4, the improvement of productivity can be achieved, without causing a deterioration in the feeding performance.

Further, in the above-described Examples 1 to 4, the retard roller 104 to which driving is transmitted in the direction opposite to the feeding direction of the sheets S was described as an example. However, the present invention can also be applied to a so-called separation roller to which driving is not transmitted from a driving source.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-246426, filed Dec. 22, 2017, and Japanese Patent Application No. 2018-209244, filed Nov. 6, 2018, which are hereby incorporated by reference herein in their entirety.

What is claimed is:

1. A sheet feeding apparatus comprising:

a sheet stacking unit on which sheets are stacked;

a feeding rotary member configured to feed the sheet from the sheets stacking unit;

a conveyance rotary member configured to convey the sheets fed by the feeding rotary member;

a separation rotary member forming a nip portion with the conveyance rotary member, and separating sheets at the nip portion, the separation rotary member urged to the conveyance rotary member by an urging member;

an output unit configured to output a signal according to a rotation state of the separation rotary member;

a driving unit configured to drive the feeding rotary member; and a control unit configured to control the driving unit to make the feeding rotary member feed a first sheet, determine a timing at which vibration of the separation rotary member is converged after passing of the first sheet through the nip portion, based on the signal output from the output unit, and change a timing at which the feeding rotary member feeds a second sheet following the first sheet to a timing when or after the timing at which vibration of the separation rotary member is converged.

2. A sheet feeding apparatus according to claim 1, wherein the separation rotary member includes a torque limiter, and receives a driving force to rotate in a direction opposite to a sheet conveyance direction.

3. A sheet feeding apparatus according to claim 1, wherein the control unit determines a timing at which an absolute value of an angular acceleration of the separation rotary member is less than a predetermined value as the timing at which vibration of the separation rotary member is converged, based on the signal output from the output unit.

4. A sheet feeding apparatus according to claim 3, wherein the control unit sets in advance a timing at which feeding of the second sheet is started to a timing at which a first time elapses after feeding of the first sheet is started, wherein in a case in which the control unit determines that the absolute value of the angular acceleration of the separation rotary member is less than the predetermined value until the first time elapses, the control unit starts feeding of the second sheet at the timing at which the first time elapses, and in a case in which the control unit is unable to determine that the absolute value of the angular acceleration of the separation rotary member is less than the predetermined value even after the first time elapses, the control unit starts feeding of the second sheet based on a timing at which the control unit determines that the absolute value of the angular acceleration of the separation rotary member is less than an absolute value of a predetermined angular acceleration after the first time elapses.

5. A sheet feeding apparatus comprising:

a sheet stacking unit on which sheets are stacked;

a feeding rotary member configured to feed the sheets from the sheet stacking unit;

a conveyance rotary member configured to convey the sheets fed by the feeding rotary member;

a separation rotary member forming a nip portion with the conveyance rotary member, and separating sheets at the nip portion, the separation rotary member urged to the conveyance rotary member;

an output unit configured to output a signal according to a rotation state of the separation rotary member;

a driving unit configured to drive the feeding rotary member, a control unit configured to control the driving unit to make the feeding rotary member feed a first sheet, and change a timing at which the feeding rotary member feeds a second sheet following the first sheet based on the signal output from the output unit after a trailing edge of the first sheet passes the nip portion, wherein the separation rotary member includes a torque limiter, wherein the conveyance rotary member includes a one-way clutch, and wherein the control unit makes the feeding rotary member start feeding of the second sheet based on a timing at which the control unit determines that rotation of the separation rotary member is in a stop condition based on the signal output from the output unit.

6. A sheet feeding apparatus according to claim 5, wherein the control unit sets in advance a timing at which feeding of the second sheet is started to a timing at which the first time elapses after feeding of the first sheet is started, wherein in a case in which the control unit determines that rotation of the separation rotary member is in the stop condition until the first time elapses, the control unit starts feeding of the second sheet at the timing at which the first time elapses, and in a case in which the control unit is unable to determine that rotation of the separation rotary member is in the stop condition even after the first time elapses, the control unit starts feeding of the second sheet based on a timing at which the control unit determines that rotation of the separation rotary member is in the stop condition after the first time elapses.

7. A sheet feeding apparatus according to claim 1, further comprising:

a second conveyance rotary member provided downstream of the nip portion in a sheet conveyance direction, wherein the control unit makes the feeding rotary member start feeding of the second sheet after a leading edge of the first sheet passes through the second conveyance rotary member.

8. A sheet feeding apparatus according to claim 1, wherein the driving unit includes a driving source configured to generate a driving force, and a clutch configured to connect the feeding rotary member to the driving source or to disconnect the feeding rotary member from the driving source, wherein the control unit starts feeding of the second sheet by connecting the feeding rotary member to the driving source by controlling the clutch based on the signal output from the output unit, after a trailing edge of the first sheet fed by the feeding rotary member passes through the nip portion.

9. A sheet feeding apparatus according to claim 8, wherein the control unit separates the feeding rotary member contacting the first sheet from the first sheet after a leading edge of the first sheet passes though the nip portion, and makes the feeding rotary member contact the first sheet again at a timing at which a predetermined time elapses after a timing at which the clutch connects the feeding rotary member to the driving source.

10. A sheet feeding apparatus according to claim 9, wherein the predetermined time is determined based on a length of the first sheet in a conveyance direction.

11. A sheet feeding apparatus comprising:

a sheet stacking unit on which sheets are stacked;

a feeding rotary member configured to feed the sheets from the sheet stacking unit;

a conveyance rotary member configured to convey the sheets fed by the feeding rotary member;

a separation rotary member forming a nip portion with the conveyance rotary member, and separating sheets at the nip portion, the separation rotary member urged to the conveyance rotary member by an urging member;

a holder configured to hold the separation rotary member;

a detection unit configured to detect an acceleration of the holder;

a driving unit configured to drive the feeding rotary member; and a control unit configured to control the driving unit to make the feeding rotary member feed a first sheet, and change a timing at which the feeding rotary member feeds a second sheet following the first sheet based on the acceleration detected by the detection unit after a trailing edge of the first sheet passes the nip portion.

12. A sheet feeding apparatus according to claim 11, wherein the control unit determines a timing at which vibration of the separation rotary member after passing of the first sheet through the nip portion is converged, based on the acceleration detected by the detection unit, and changes the timing at which the feeding rotary member feeds the second sheet to a timing after the vibration of the separation rotary member is converged.

13. A sheet feeding apparatus according to claim 11, wherein the control unit makes the feeding rotary member start feeding of the second sheet, based on a timing at which an absolute value of the acceleration detected by the detection unit becomes equal to or less than a predetermined value.

14. A sheet feeding apparatus according to claim 13, wherein the control unit sets in advance the timing at which feeding of the second sheet is started to a timing at which a first time elapses after feeding of the first sheet is started, wherein in a case in which the control unit determines that the absolute value of the acceleration detected by the detection unit is less than the predetermined value until the first time elapses, the control unit starts feeding of the second sheet at the timing at which the first time elapses, and in a case in which the control unit is unable to determine that the absolute value of the acceleration detected by the detection unit is less than the predetermined value even after the first time elapses, the control unit starts feeding of the second sheet based on a timing at which the control unit determines that the absolute value of the acceleration detected by the detection unit is less than the predetermined value after the first time elapses.

15. A sheet feeding apparatus according to claim 11, further comprising:

a second conveyance rotary member provided downstream of the nip portion in a sheet conveyance direction, wherein the control unit makes the feeding rotary member start feeding of the second sheet after a leading edge of the first sheet passes the second conveyance rotary member.

16. A sheet feeding apparatus according to claim 11, wherein the driving unit includes a driving source configured to generate a driving force, and a clutch configured to connect the feeding rotary member to the driving source or disconnect the feeding rotary member from the driving source, wherein the control unit starts feeding of the second sheet by connecting the feeding rotary member to the driving source by controlling the clutch based on the acceleration detected by the detection unit, after a trailing edge of the first sheet fed by the feeding rotary member passes through the nip portion.

17. A sheet feeding apparatus according to claim 16, wherein the control unit separates the feeding rotary member contacting the first sheet from the first sheet after a leading edge of the first sheet passes the nip portion, and makes the feeding rotary member contact the first sheet again at a timing at which predetermined time passes after a timing at which the clutch connects the feeding rotary member to the driving source.

18. A sheet feeding apparatus according to claim 17, wherein the predetermined time is determined based on a length of the first sheet in a conveyance direction.

* * * * *